United States Patent [19]

Waki

[11] Patent Number: 4,830,956

[45] Date of Patent: May 16, 1989

[54] SILVER HALIDE COLOR PHOTOGRAPHIC MATERIALS

[75] Inventor: Kokichi Waki, Kanagawa, Japan

[73] Assignee: Fuji Photo Film Co., Ltd., Kanagawa, Japan

[21] Appl. No.: 232,520

[22] Filed: Aug. 15, 1988

Related U.S. Application Data

[63] Continuation of Ser. No. 880,961, Jul. 1, 1986, abandoned.

[30] Foreign Application Priority Data

Jul. 1, 1985 [JP] Japan ..... 60-144312

[51] Int. Cl.[4] ..... G03C 7/38

[52] U.S. Cl. ..... 430/558; 430/567; 430/571

[58] Field of Search ..... 430/558, 567, 571, 599

[56] References Cited

U.S. PATENT DOCUMENTS 4,547,458 10/1985 Iijima et al. ..... 430/567
4,618,573 10/1986 Okamura et al. ..... 430/558
4,622,287 11/1986 Umemoto et al. ..... 430/558

FOREIGN PATENT DOCUMENTS 1155325 10/1983 Canada ..... 430/567

*Primary Examiner*—Paul R. Michl
*Assistant Examiner*—Mark R. Buscher
*Attorney, Agent, or Firm*—Sughrue, Mion, Zinn, Macpeak & Seas

[57] ABSTRACT

A silver halide color photographic material is provided, containing a pyrazoloazole type magenta coupler of the general formula (I):

(I)

wherein $R^1$ represents a hydrogen atom or a substituent; X represents a hydrogen atom or a group which is removable by a coupling reaction with an oxidation product of an aromatic primary amine developing agent; Za, Zb and Zc each represents a methine group, a substituted methine group, =N— or —NH—; one of Za—Zb bond and Zb—Zc bond is a double bond and the other is a single bond; one of Za—Zb and Zb—Zc may optionally be condensed with a 5- to 7-membered ring when Za and Zb or Zb and Zc are both carbon atoms; $R^1$ or X may form a dimer or higher polymer; when Za, Zb or Zc is a substituted methine group, said methine group may optionally form a dimer or higher polymer; characterized in that two or more monodispersed silver halide emulsions each having a different sensitivity are admixed and incorporated into the silver halide emulsion layer in said material, said monodispersed silver halide emulsion being regulated to have a ratio of $\sigma/\bar{d}$ of 0.2 or less, where $\sigma$ means a statistical standard deviation in the particle size distribution and $\bar{d}$ means an average particle diameter.

The present silver halide color photographic material may form a magenta image of good light absorption, and the gradation control thereof is easy. Thus, the present photographic material is characterized by improved color reproductivity and tone reproductivity.

8 Claims, No Drawings

SILVER HALIDE COLOR PHOTOGRAPHIC MATERIALS

This is a continuation of application Ser. No. 06/880,961 filed July 1, 1986, now abandoned.

FIELD OF THE INVENTION

The present invention relates to silver halide color photographic materials, and more precisely, to those having improved color reproductivity and tone reproductivity.

BACKGROUND OF THE INVENTION

For the formation of color photographic images, three photographic color couplers of yellow, magenta and cyan are incorporated into photographic layers of a photographic material, and the material is exposed to light and then developed with a color developer containing a color developing agent. In said process, an oxidation product of an aromatic primary amine is reacted with a coupler by a coupling reaction, whereby a color-forming dye is formed. In the formation of said color-forming dye, it is preferred that the coupling reaction speed is as high as possible and that the coupler has a higher color formability, so that a color image having a higher color density may be obtained within a limited shorter developing period of time. In addition, it is required that the color-forming dyes are sharp yellow, magenta and cyan dyes each with less side absorption and that color photographic images of good color reproduction are obtained.

Under the circumstances, the role of the couplers is great, and therefore, various studies have heretofore been made for the modification of the structures of various couplers to improve them. In particular, magenta couplers are important in view of the luminosity thereof, and 5-pyrazolone derivatives have essentially been used therefor.

However, color images as formed from the magenta couplers of said 5-pyrazolone derivatives not only have an absorption in the green light region but also have some unnecessary absorption in the blue light region and red light region, and therefore, it cannot be said as yet that said magenta couplers have sufficient coloring characteristics. In addition 5-pyrazolone derivatives are apt to decompose and yellow when exposed to light or kept under high humidity, and therefore, these are unsatisfactory in view of the preservation stability of the formed images.

On the other hand, it is indispensable to severely control the gradation in the color photographic images in order to improve the color reproduction and the tone reproduction of said images. When the gradation control is insufficient, the color reproduction of the formed image is bad even if the best couplers are used, and further, the tone reproduction in the highlight or shadow in the formed color photographic images is extremely deteriorated.

For control of the gradation, for example, Japanese Patent Application (OPI) No. 150841/82 (the term "OPI" as used herein refers to a "published unexamined Japanese patent application") has proposed a method for attaining soft gradation where a sensitizing dye is added to each of two or more monodispersed emulsions each having a different grain size in such a manner that the amount of said sensitizing dye to be added to an emulsion having a larger grain size is to be larger, per unit surface area of the particles and said emulsions are blended.

Following said proposal, the present inventors tried to blend plural monodispersed emulsions each having a different sensitivity and containing said magenta coupler of a 5-pyrazolone derivative for the purpose of attaining the desired gradation. However, the color reproduction was not improved in this trial.

SUMMARY OF THE INVENTION

The object of the present invention is to provide color photographic materials having satisfactory photographic characteristics of color reproduction and tone reproduction.

More precisely, the first object of the present invention is to provide color photographic materials of excellent color reproductivity containing magenta dyes with a good light absorption characteristic.

The second object of the present invention is to provide color photographic materials of good color reproductivity and tone reproductivity, containing silver halide emulsion layers of a desired gradation, the gradation control being easy.

In order to overcome the defects of the conventional silver halide color photographic materials as mentioned above and to attain said objects of the present invention, the present inventors have variously studied the related techniques and as a result thereof have found that the aforesaid objects of the present invention may be achieved by the incorporation of two or more monodispersed silver halide emulsions each having a different sensitivity in silver halide emulsion layers in a silver halide color photographic material containing a pyrazoloazole type magenta coupler of the general formula (I) given below, and thus have completed the present invention on the basis of the discovery of said novel technical idea.

Therefore, the present invention provides a silver halide color photographic material containing a pyrazoloazole type magenta coupler of the general formula (I):

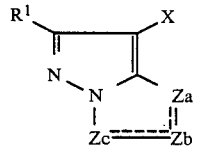

(I)

wherein $R^1$ represents a hydrogen atom or a substituent; X represents a hydrogen atom or a group which is removable by a coupling reaction with an oxidation product of an aromatic primary amine developing agent; Za, Zb and Zc each represents a methine group, a substituted methine group, =N— or —NH—; one of Za—Zb bond and Zb—Zc bond is a double bond and the other is a single bond; one of Za—Zb and Zb—Zc may optionally be condensed with a 5- to 7-membered ring when Za and Zb or Zb and Zc are both carbon atoms; $R^1$ or X may optionally form a dimer or higher polymer; when Za, Zb or Zc is a substituted methine group, said methine group may optionally form a dimer or higher polymer; characterized in that two or more monodispersed silver halide emulsions each having a different sensitivity are admixed and incorporated into the silver halide emulsion layer in said material, said monodispersed silver halide emulsion being regulated to have a ratio of $\sigma/\bar{d}$ of 0.2 or less, where $\sigma$ means a statistical standard deviation in the particle size distribution and $\bar{d}$ means an average particle diameter.

DETAILED DESCRIPTION OF THE INVENTION

Now, the present invention will be explained in greater detail hereunder.

In the compounds of the formula (I), polymers means those containing two or more units of the formula (I) in one molecule, including bis compounds and polymer couplers. The polymer couplers may be either homopolymers comprising only the monomers having the unit of the formula (I) (preferably vinyl group-containing monomers which are hereinafter referred to as "vinyl monomers") or copolymers comprising said monomers of the formula (I) and some other non-coloring ethylenic monomers which are not coupled with an oxidation product of an aromatic primary amine developing agent.

$R^1$ and X in the formula (I) have the same significance as $R^{11}$ and X in the following formulae (II) through (VIII), respectively.

Preferred pyrazoloazole type magenta couplers among those of the aforesaid formula (I) are represented by the following general formulae (II), (III), (IV), (V), (VI), (VII) and (VIII):

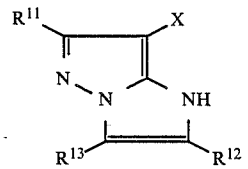

(II)

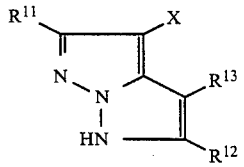

(III)

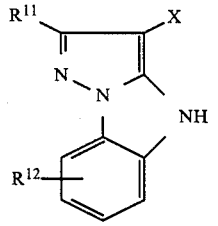

(IV)

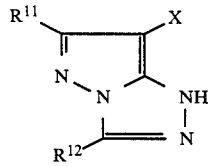

(V)

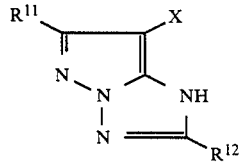

(VI)

-continued

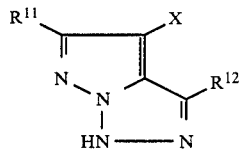

(VII)

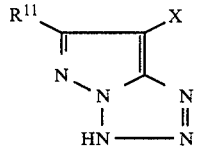

(VIII)

Among the couplers of said formulae (II) through (VIII), those of the formulae (II), (V) and (VI) are preferred for the object of the present invention, and in particular, the couplers of the formula (VI) are especially preferred.

In these formulae (II) through (VIII), $R^{11}$, $R^{12}$ and $R^{13}$ may be the same or different and each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; X represents a hydrogen atom, a halogen atom, a carboxyl group or a group which is removable by coupling and which is bonded to the carbon atom in the coupling position via an oxygen atom, a nitrogen atom or a sulfur atom; said $R^{11}$, $R^{12}$, $R^{13}$ or X may be a divalent group to form a bis compound; and in the formulae (II) and (III), $R^{12}$ and $R^{13}$ may be bonded together to form a 5- to 7-membered ring.

The coupler residues of the formulae (II) through (VIII) may form polymer couplers, as existing in the main chain or the side chain thereof. In particular, polymers derived from such vinyl monomers as having the unit of said general formulae are preferred, in which $R^{11}$, $R^{12}$, $R^{13}$ or X represents a vinyl group or a binding group.

More precisely, $R^{11}$, $R^{12}$ and $R^{13}$ each represents a hydrogen atom, a halogen atom (such as a chlorine atom, a bromine atom), an alkyl group (such as a methyl group, a propyl group, a t-butyl group, a trifluoromethyl group, a tridecyl group, a 3-(2,4-di-t-amylphenoxy) propyl group, an allyl group, a 2-dodecyloxyethyl group, a 3-phenoxypropyl group, a 2-hexylsulfonylethyl group, a cyclopentyl group, a benzyl group), an aryl group (such as a phenyl group, a 4-t-butylphenyl group, a 2,4-di-t-amylphenyl group, a 4-tetradecanamidophenyl group), a heterocyclic group (such as a 2-furyl group, a 2-thienyl group, a 2-pyrimidyl group, a 2-benzothiazolyl group), a cyano group, an alkoxy group (such as a methoxy group, an ethoxy group, a 2-methoxyethoxy group, a 2-dodecyloxyethoxy group, a 2-methanesulfonylethoxy group), an aryloxy group (such as a phenoxy group, a 2-methylphenoxy group, a 4-t-butylphenoxy group), a heterocyclic oxy group (such as a 2-benzimidazolyloxy group), an acyloxy group (such as an acetoxy group, a hexadecanoyloxy group), a carbamoyloxy group (such as an N-phenylcarbamoyloxy group, an N-ethylcarbamoyloxy group), a silyloxy group (such as a trimethylsilyloxy group), a sulfonyloxy group (such as a dodecylsulfonyloxy group), an acylamino group (such as an acetamido group, a benzamido group, a tetradecanamido group, an α-(2,4-di-t-amylphenoxy) butyramido group, a γ-(3-t-butyl-4-hydroxyphenoxy) butyramido group, an α[4-(4-hydroxyphenylsulfonyl) phenoxy]decanamido group), an anilino group (such as a phenylamino group, a 2-chloroanilino group, a 2-chloro-5-tetradecanamidoanilino group, a 2-chloro-5-dodecyloxycarbonylanilino group, an N-acetylanilino group, a 2-chloro-5-[α-(3-t-butyl-4-hydroxyphenoxy)-dodecanamido]anilino group), ureido group (such as a phenylureido group, a methylureido group, an N,N-dibutylureido group), an imido group (such as an N-succinimido group, a 3-benzylhydantoinyl group, a 4-(2-ethylhexanoylamino) phthalimido group), a sulfamoylamino group (such as an, N,N-dipropylsulfamoylamino group, an N-methyldecylcarbomolamino group), an alkylthio group (such as a methylthio group, an octylthio group, a tetradecylthio group, a 2-phenoxyethylthio group, a 3-phenoxypropylthio group, a 3-(4-butylphenoxy)propylthio group), an arylthio group (such as a phenylthio group, a 2-butoxy-5-t-octylphenylthio group, a 3-pentadecylphenylthio group, a 2-carbophenylthio group, a 4-tetradecanamidophenylthio group), a heterocyclic thio group (such as 2-benzothiazolythio group), an alkoxycarbonylamino group (such as a methoxycarbonylamino group, a tetradecyloxycarbonylamino group), an aryloxycarbonylamino group (such as a phenoxycarbonylamino group, a 2,4-di-tert-butylphenoxycarbonylamino group), a sulfonamido group (such as a methanesulfonamido group, a hexadecanesulfonamido group, a benzenesulfonamido group, a p-toluenesulfonamido group, an octadecanesulfonamido group, a 2-methyloxy-5-t-butylbenzenesulfonamido group), a carbamoyl group (such as an N-ethylcarbamoyl group, an N,N-dibutylcarbamoyl group, an N-(2-dodecyloxyethyl)carbamoyl group, an N-methyl-N-dodecylcarbamoyl group, an N-[3-(2,4-di-tert-amylphenoxy)propyl]-carbamoyl group), an acyl group (such as an acetyl group, a (2,4-di-tert-amylphenoxy)acetyl group, a benzoyl group), a sulfamoyl group (such as an N-ethylsulfamoyl group, an N,N-dipropylsulfamoyl group, an N-(2-dodecyloxyethyl) sulfamoyl group, an N-ethyl-N-dodecylsulfamoyl group, an N,N-diethylsulfamoyl group), a sulfonyl group (such as a methanesulfonyl group, an octanesulfonyl group, a benzenesulfonyl group, a toluenesulfonyl group), a sulfinyl group (such as an octanesulfinyl group, a dodecylsulfinyl group, a phenylsulfinyl group), an alkoxycarbonyl group (such as a methoxycarbonyl group, a butyloxycarbonyl group, a dodecyloxycarbonyl group, an octadecyloxycarbonyl group, a 3-pentadecyloxycarbonyl group), or an aryloxycarbonyl group (such as a phenyloxycarbonyl group); and X represents a hydrogen atom, a halogen atom (such as a chlorine atom, a bromine atom, an iodine atom), a carboxyl group, or a group which is removable by coupling and which is to be bound via an oxygen atom (such as an acetoxy group, a propanoyloxy group, a benzoyloxy group, a 2,4-dichlorobenzoyloxy group, an ethoxyoxaloyloxy group, a pyruvinyloxy group, a cinnamoyloxy group, a phenoxy group, a 4-cyanophenoxy group, a 4-methanesulfonamidophenoxy group, a 4-methanesulfonylphenoxy group, an α-naphthoxy group, a 3-pentadecylphenoxy group, a benzyloxycarbonyloxy group, an ethoxy group, a 2-cyanoethoxy group, a benzyloxy group, a 2-phenethyloxy group, a 2-phenoxyethoxy group, a 5-phenyltetrazolyloxy group, a 2-benzothiazolyloxy group), a group which is removable by coupling and which is to be bound via a nitrogen atom (such as a benzenesulfonamido group, an N-ethyltoluenesulfonamido group, a heptafluorobutanamido group, a 2,3,4,5,6-pentafluorobenzamido group, an octanesulfonamido group, a p-cyanophenylureido group, an N,N-diethylsulfamoylamino group, a 1-piperidyl group, a 5,5-dimethyl-2,4-dioxo -3-oxazolidinyl group, a 1-benzylethoxy 3-hydantoinyl group, a 2-[1,1dioxo-3 (2H)-oxo-1,2-benzisothiazolyl] group, a 2-oxo-1,2-dihydro-1-pyridinyl group, an imidazolyl group, a pyrazolyl group, a 3,5-diethyl-1,2,4-triazol-1-yl group, a 5- or 6-bromobenzotriazol-1-yl group, a 5-methyl-1,2,3,4-triazol-1-yl group, a benzimidazolyl group, a 3-benzyl-1-hydantoinyl group, a 1-benzyl-5-hexadecyloxy-3-hydantoinyl group, a 5-methyl-1-tetrazolyl group), an arylazo group (such as a 4-methoxyphenylazo group, a 4-pivaloylaminophenylazo group, a 2-naphthylazo group, a 3-methyl-4-hydroxyphenylazo group), a group which is removable by coupling and which is to be bound via a sulfur atom (such as a phenylthio group, a 2-carboxyphenylthio group, a 2-methoxy-5-t-octylphenylthio group, a 4-methanesulfonylthio group, a 4-octanesulfonamidophenylthio group, a 2-butoxyphenylthio group, a 2-(2-hexanesulfonylethyl)-5-tert-octylphenylthio group, a benzylthio group, a 2-cyanoethylthio group, a 1-ethoxycarbonyltridecylthio group, a 5-phenyl-2,3,4,5-tetrazolylthio group, a 2-benzothiazolylthio group, a 2-dodecylthio-5-thiophenylthio group, a 2-phenyl-3-dodecyl-1,2,4-triazolyl-5-thio group).

In the case when $R^{11}$, $R^{12}$, $R^{13}$ or X is a divalent group to form a bis structural compound, said $R^{11}$, $R^{12}$ or $R^{13}$ preferably represents a substituted or unsubstituted alkylene group (such as a methylene group, an ethylene group, a 1,10-decylene group, $—CH_2CH_2—O—CH_2CH_2—$), a substituted or unsubstituted phenylene group (such as a 1,4-phenylene group, a 1,3-phenylene group,

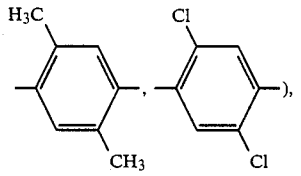

an —NHCO—$R^{14}$—CONH— group (where $R^{14}$ is a substituted or unsubstituted alkylene or phenylene group, for example, $—NHCOCH_2CH_2CONH—$,

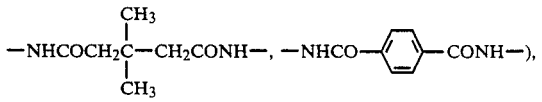

an —S—$R^{14}$—S— group (where $R^{14}$ is a substituted or unsubstituted alkylene group, for example, $—S—CH_2CH_2—S—$,

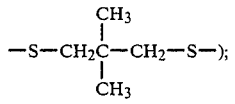

and X represents a divalent group, corresponding to the aforesaid monovalent groups for X.

In the case where the unit of said formulae (II), (III), (IV), (V), (VI), (VII) and (VIII) form vinyl monomers, the binding group represented by $R^{11}$, $R^{12}$, $R^{13}$ or X therein contains a combination selected from an alkylene group (or a substituted or unsubstituted alkylene group such as a methylene group, an ethylene group, a 1,10-decylene group, $—CH_2CH_2OCH_2CH_2—$), a phenylene group (or a substituted or unsubstituted phenylene group such as a 1,4-phenylene group, a 1,3-phenylene group,

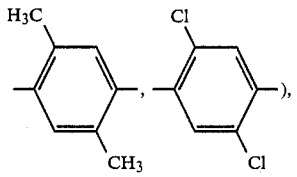

—NHCO—, —CONH—, —O—, —OCO— or an aralkylene group (such as

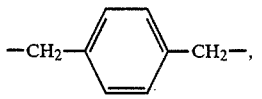

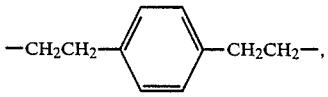

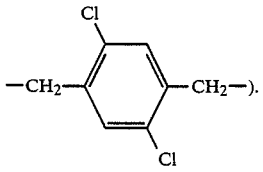

Preferred binding groups among them are as follows:

—NHCO—,

—$CH_2CH_2$—,

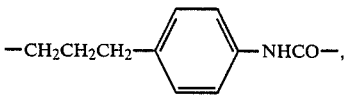

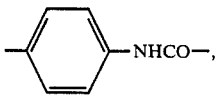

—$CH_2CH_2NHCO$—,

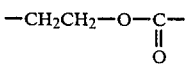

-continued

—$CONH—CH_2CH_2NHCO$—,

—$CH_2CH_2O—CH_2CH_2—NHCO$—,

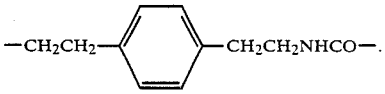

The vinyl groups which constitute the polymer couplers of the present invention may have any other substituents than the units of said formulae (II), (III), (IV), (V), (VI), (VII) and (VIII), and preferred substituents are a hydrogen atom, a chlorine atom or a lower alkyl group having 1 to 4 carbon atoms (such as a methyl group, an ethyl group).

The monomers containing the unit represented by the aforesaid formulae (II), (III), (IV), (V), (VI), (VII) and (VIII) may form copolymers together with some other non-coloring ethylenic monomers which are not coupled with an oxidation product of an aromatic primary amine developing agent.

Non-coloring ethylenic monomers which are not coupled with an oxidation product of an aromatic primary amine developing agent include, for example, acrylic acid, α-chloroacrylic acid, α-alkylacrylic acids (such as methacrylic acid) and esters or amides derived from said acrylic acids (such as acrylamide, n-butylacrylamide, t-butylacrylamide, diacetonacrylamide, methacrylamide, methyl acrylate, ethyl acrylate, n-propyl acrylate, n-butyl acrylate, t-butyl acrylate, isobutyl acrylate, 2-ethylhexyl acrylate, n-octyl acrylate, lauryl acrylate, methyl methacrylate, ethyl methacrylate, n-butyl methacrylate and β-hydroxyethyl methacrylate), methylenebisacrylamides, vinyl esters (such as vinyl acetate, vinyl propionate and vinyl laurate), acrylonitriles, methacrylonitriles, aromatic vinyl compounds (such as styrene and derivatives thereof, vinyltoluene, divinylbenzene, vinylacetophenone and sulfostyrene), itaconic acid, citraconic acid, crotonic acid, vinylidene chloride, vinylalkyl ethers (such as vinylethyl ether), maleic acid, maleic anhydride, maleates, N-vinyl-2-pyrrolidone, N-vinylpyridine and 2- and 4-vinylpyridine. These non-coloring ethylenically unsaturated monomers may be used in the form of a combination of two or more. For instance, combinations of n-butyl acrylate/methyl acrylate, styrene/methacrylic acid, methacrylic acid/acrylamide or methyl acrylate/diacetonacrylamide may be mentioned.

As is well known in the technical field of polymer color couplers, the non-coloring ethylenically unsaturated monomers to be copolymerized with a solid and water-insoluble monomer coupler are preferably so selected that said ethylenic monomers may have a good influence on the physical and/or chemical properties of the copolymers formed such as the solubility, the compatibility with binders of photographic colloid compositions (e.g., gelatin), the flexibility and the thermal stability.

The polymer couplers to be used in the present invention may be either soluble or insoluble in water, and in particular, polymer coupler latexes are preferred.

Concrete examples of pyrazoloazole type magenta couplers of the aforesaid formula (I) and the method for the formation thereof are described in Japanese Patent Application Nos. 23434/83, 151354/83, 45512/83, 27745/84 and 142801/83 (corresponding to Japanese Patent Application (OPI) Nos. 162548/84, 43659/85, 171956/84, 172982/85 and 33552/85, respectively) and U.S. Pat. No. 3,061,432, etc.
Typical examples of magenta couplers and vinyl monomers thereof which may be used in the present invention will be given hereunder, which, however, do not whatsoever restrict the scope of the present invention.
(M-1)
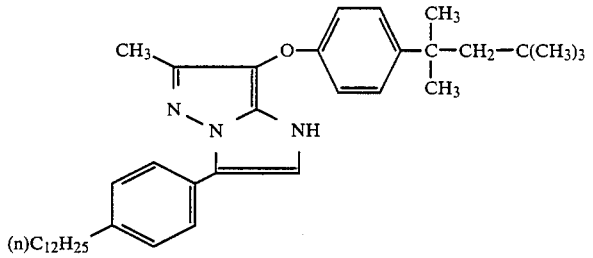
(M-2)
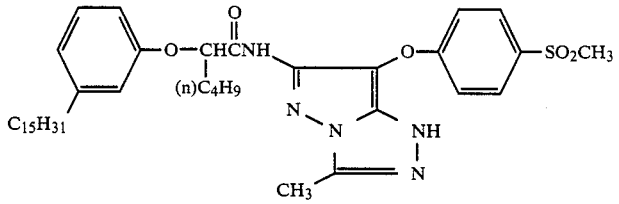
(M-3)
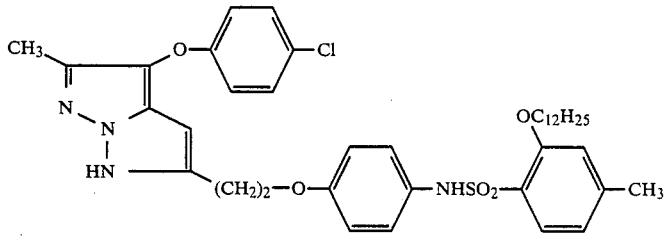
(M-4)
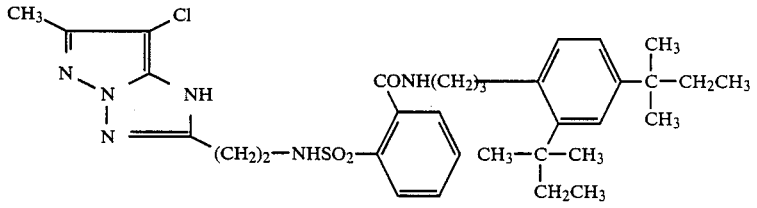
(M-5)
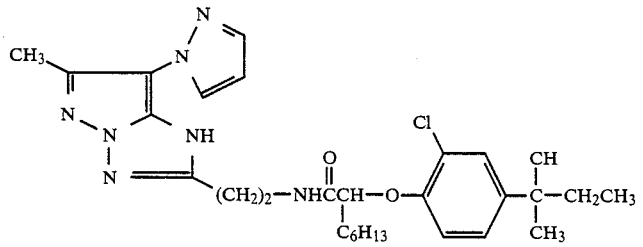
(M-6)
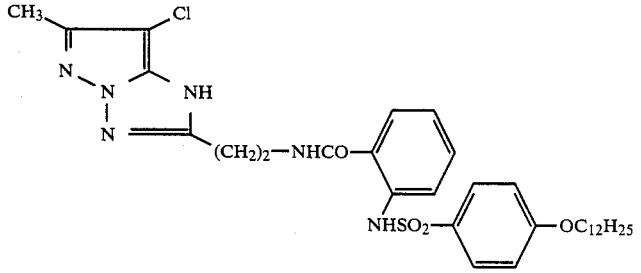

-continued
(M-7)
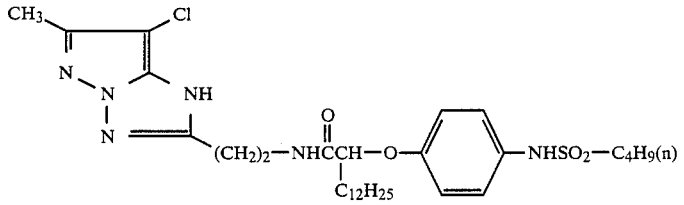
(M-8)
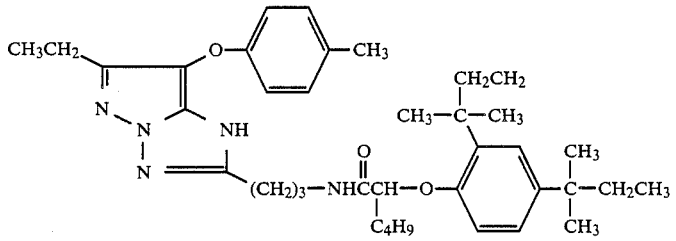
(M-9)
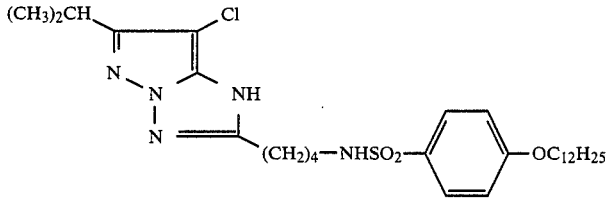
(M-10)
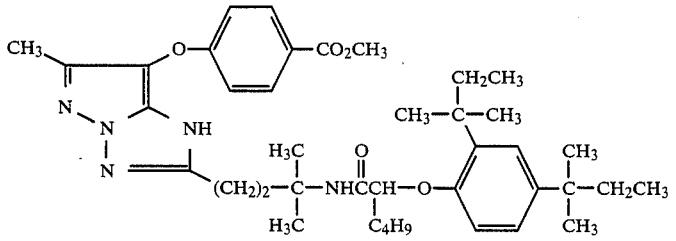
(M-11)
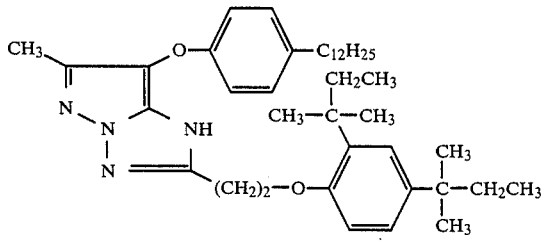
(M-12)
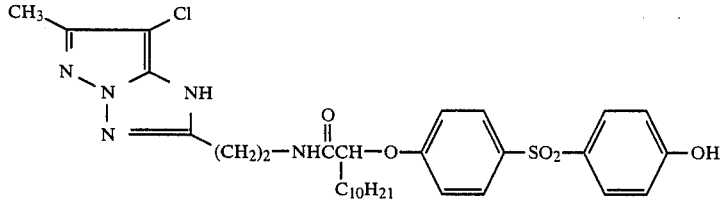
(M-13)
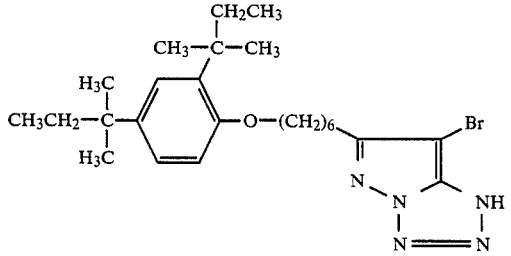

-continued
(M-14)
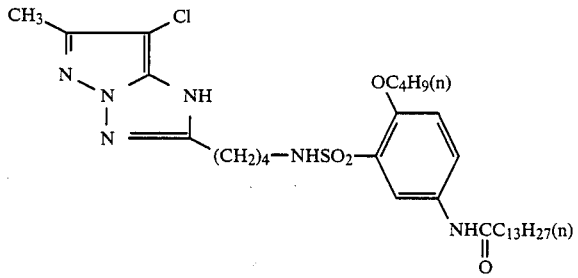
(M-15)
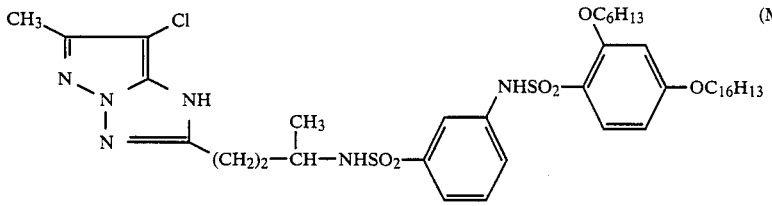
(M-16)
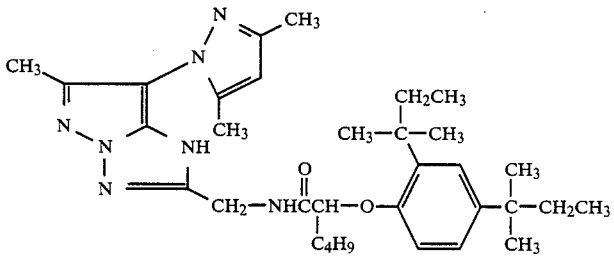
(M-17)
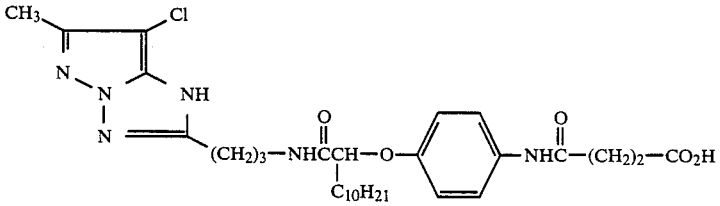
(M-19)
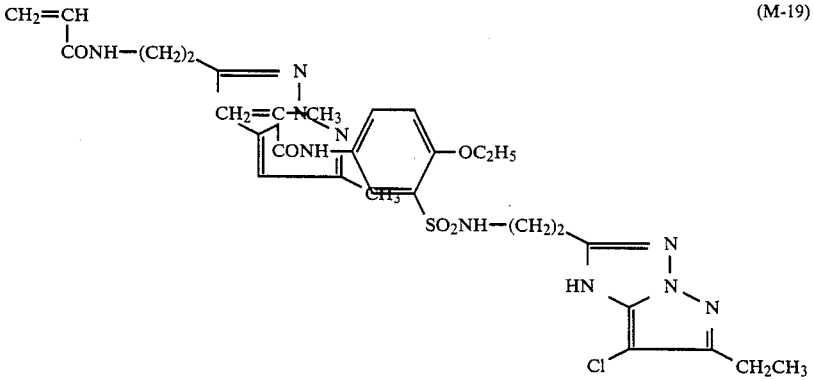
(M-20)
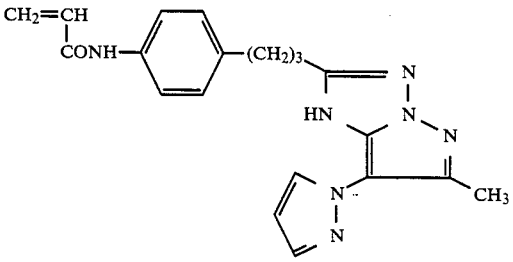

-continued
(M-21)
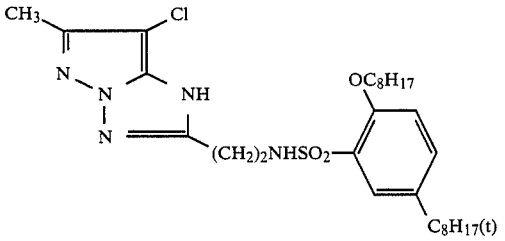
(M-22)
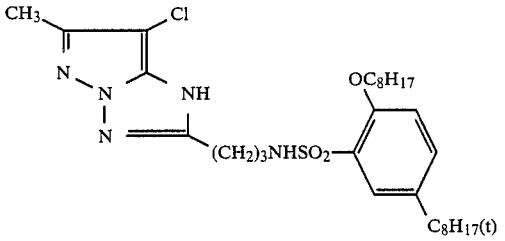
(M-23)
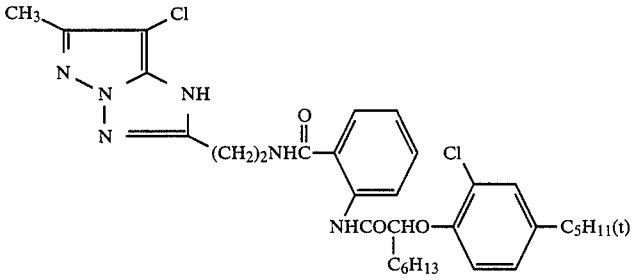
(M-24)
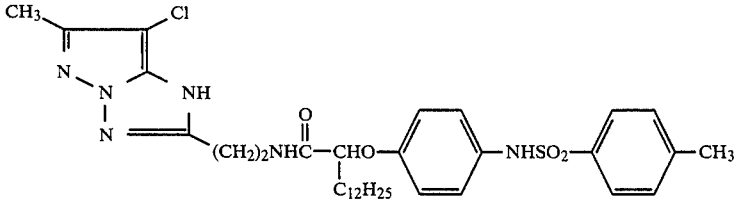
(M-25)
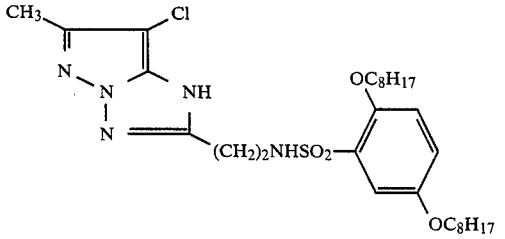
(M-26)
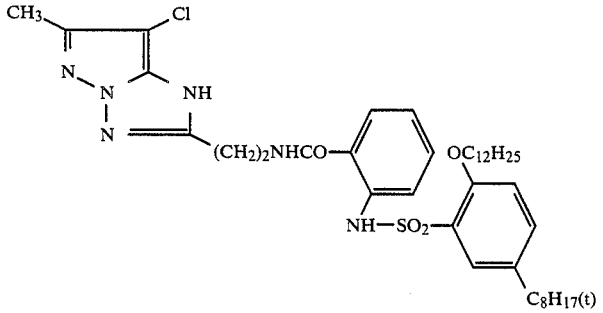

-continued
(M-27)
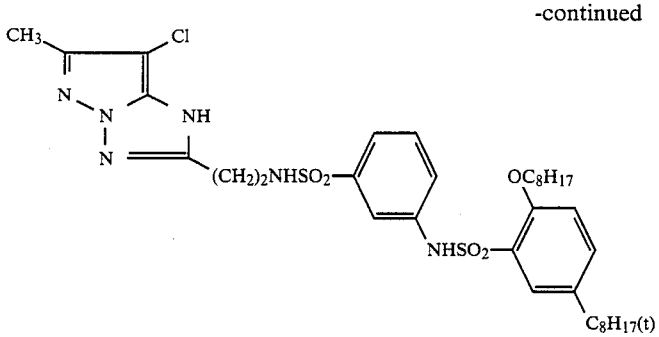
(M-28)
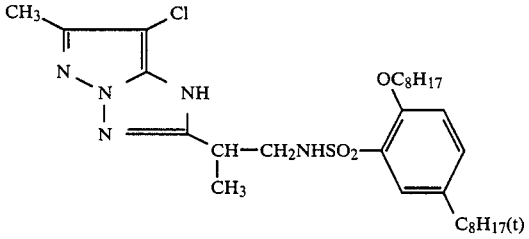
(M-29)
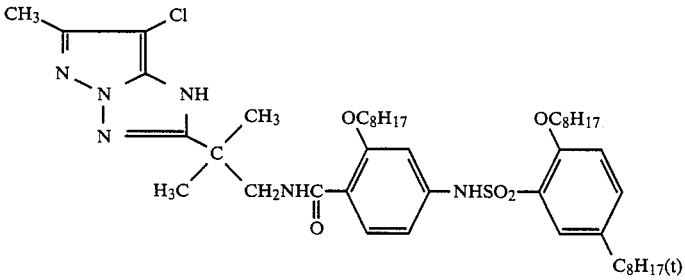
(M-30)
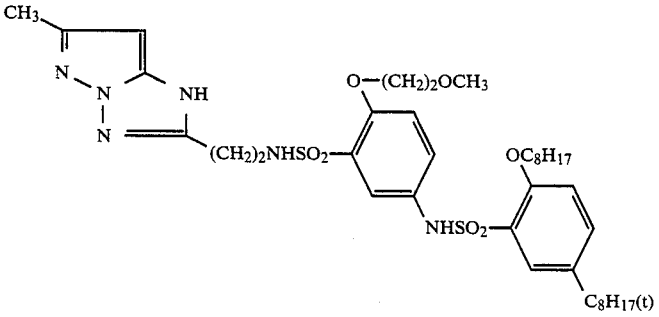
(M-31)
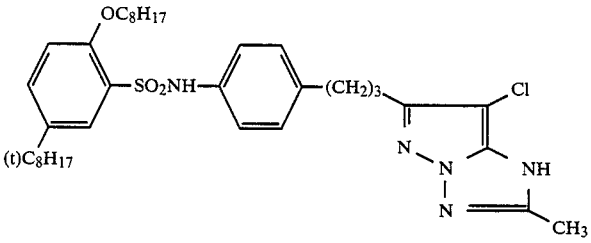
(M-32)
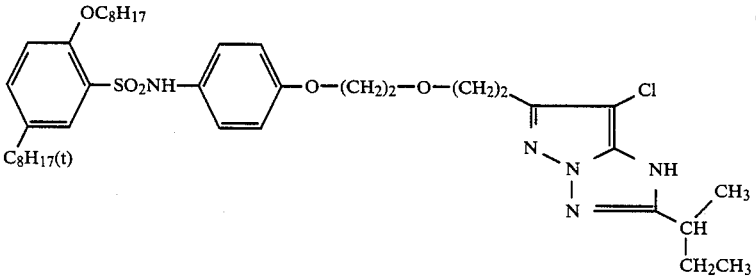

-continued
(M-33)
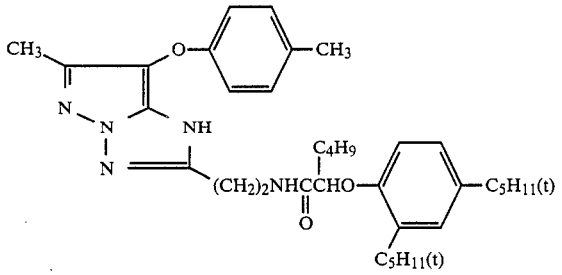
(M-34)
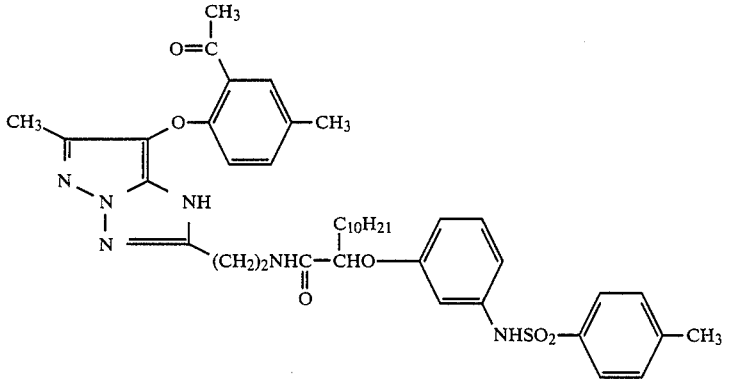
(M-35)
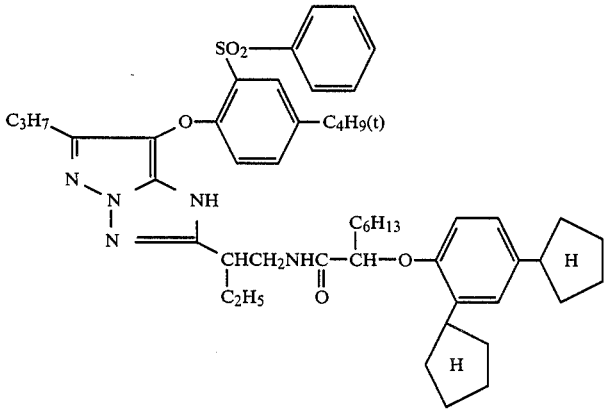
(M-36)
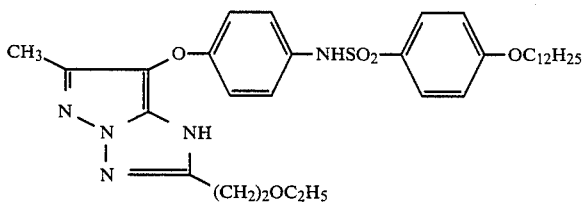
(M-37)
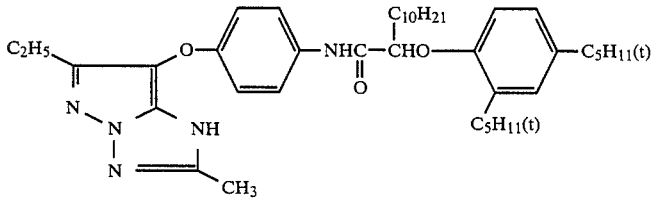

-continued
(M-38)
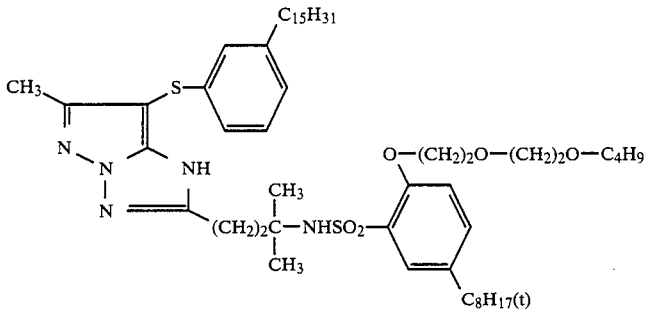
(M-39)
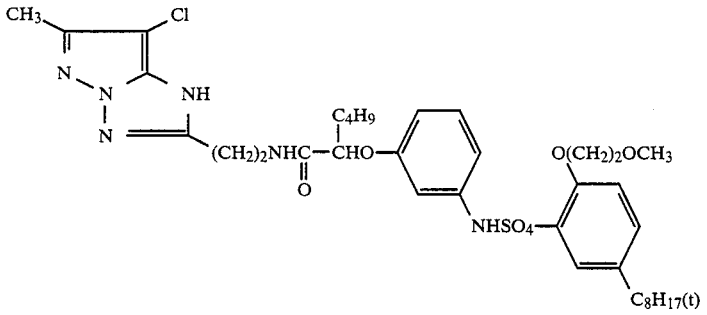
(M-40)
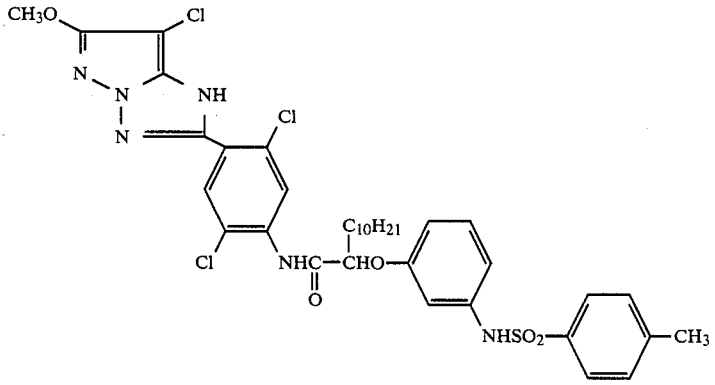
(M-41)
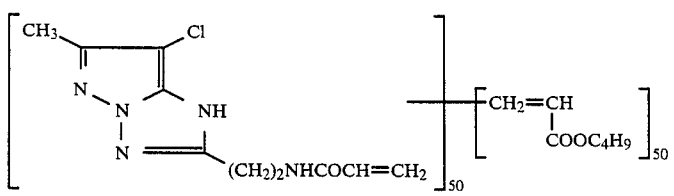
(M-42)
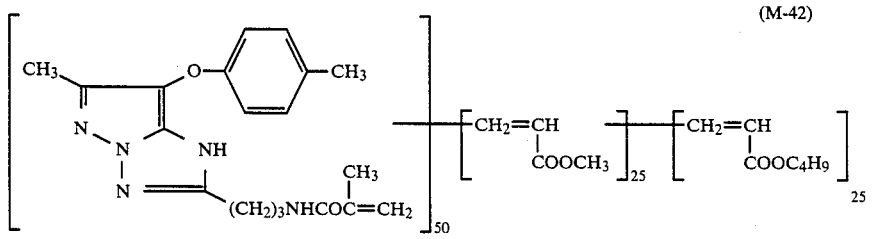

-continued
(M-43)
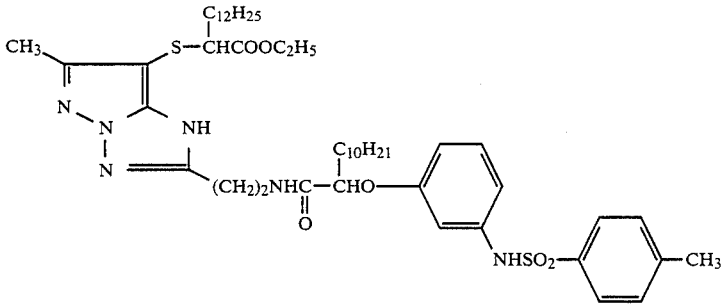
(M-44)
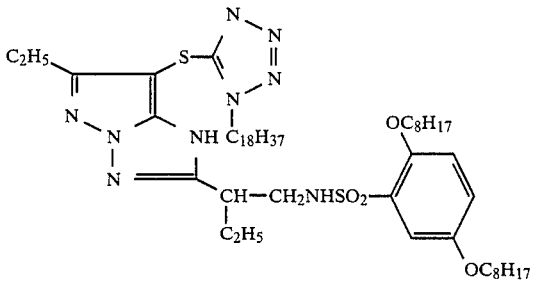
(M-45)
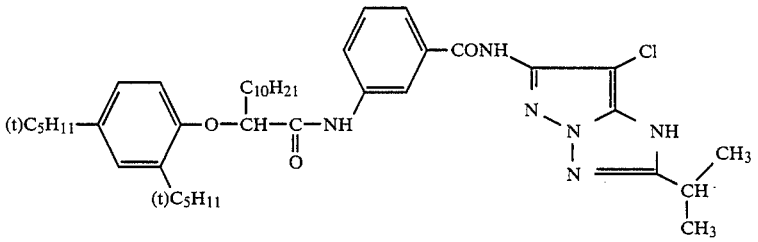
(M-46)
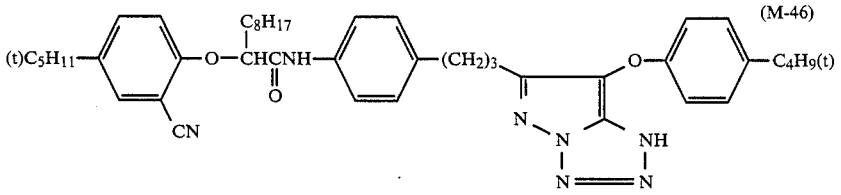
(M-47)
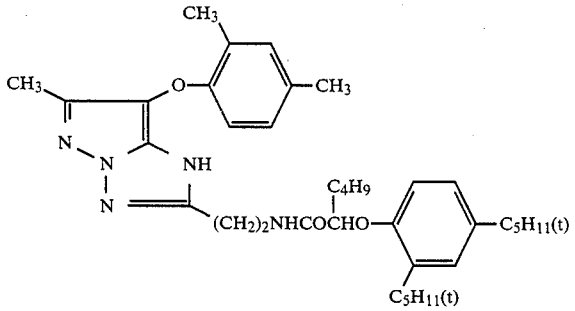
(M-48)
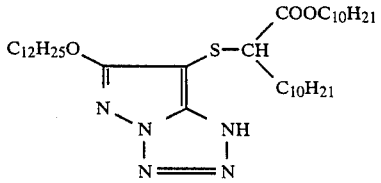

-continued

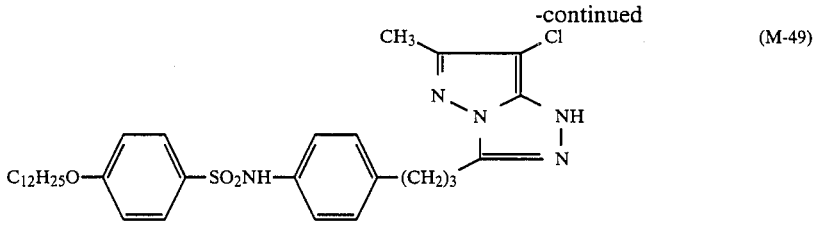
(M-49)

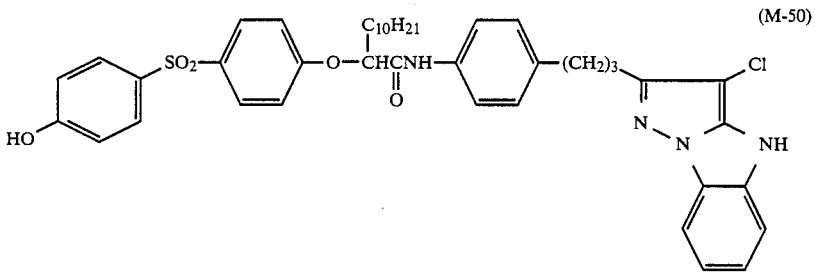
(M-50)

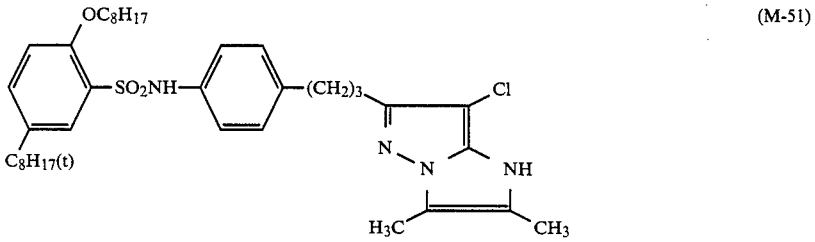
(M-51)

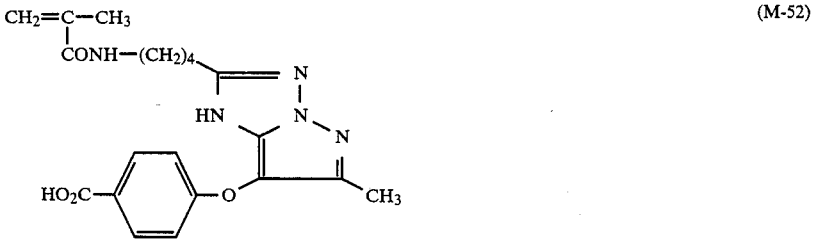
(M-52)

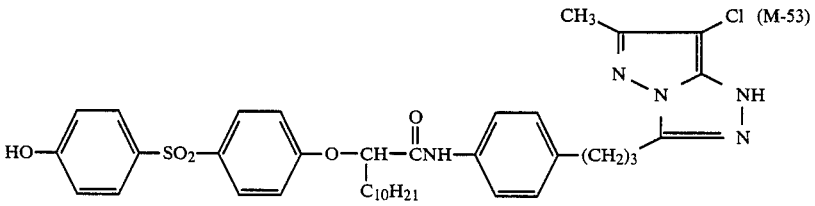
(M-53)

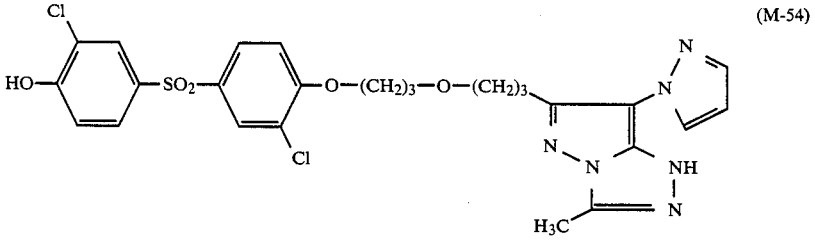
(M-54)

The coupler of the present invention, which is represented by the aforesaid formula (I), is added to the emulsion layer in an amount of $1\times10^{-3}$ mol to 1 mol, preferably $5\times10^{-2}$ mol to $5\times10^{-1}$ mol, per mol of the silver halide contained in said emulsion layer. Two or more different kinds of the couplers of the present invention may be added to one and the same emulsion layer.

The monodispersed silver halide emulsions to be used in the present invention may be prepared by means of conventional methods as described, for example, in *Chimie et Physique Photographique* (written by P. Glafkides and published by Paul Montel in 1967), *Photographic Emulsion Chemistry* (written by G. F. Duffin and published by Focal Press in 1966) and *Making and Coating Photographic Emulsion* (written by V. L. Zelikman et al. and published by Focal Press in 1964). Said emulsions may be prepared by any of an acidic method, a neutral method or an ammonia method, and, for example, monodispersed silver halide emulsions of narrow particle size distribution may be obtained by means of a controlled double jet method where a water-soluble silver salt and a water-soluble halide are simultaneously added to the liquid reaction system to form silver halide particles while the pAg value of said liquid reaction system is kept constant or by means of a method where a water-soluble silver salt and a water-soluble halide are simultaneously added to the reaction system in the presence of a known organic solvent for silver halides (such as thioethers and thione compounds as described in U.S. Pat. No. 3,271,157 and Japanese Patent Application (OPI) Nos. 12360/76, 82408/78, 144319/78, 158917/79 and 77737/80).

Typical silver halides to be used in the present invention are silver chloride and silver bromide as well as other mixed silver halides such as silver bromochloride, silver bromoiodochloride and silver bromoiodide. In particular, silver halides which are preferably to be used in the present invention are those which are free from silver iodide or those containing at most 3% or less silver iodide such as silver bromoiodochloride, silver chloroiodide or silver bromoiodide. The silver halide particles may comprise different inner crystalline phases and surface crystalline phases or may comprise a multicrystalline structure such as having an epitaxial crystalline constitution, or as the case may be, may comprise a wholly uniform crystalline phase. In addition, said particles may comprise a mixture of said various kinds of crystalline structures. Regarding silver bromochloride particles having different crystalline phases, for example, these may contain nuclei or single or plural layers of higher silver bromide content than the average silver halide composition in the particles, or as the case may be, these may contain nuclei or single or plural layers of higher silver bromochloride content than the average silver halide composition in the particles. Accordingly, the surface layers of the particles may comprise a phase of higher silver bromide content than the average silver halide composition or on the contrary a phase of higher silver chloride content, as coating the nuclei.

Said emulsion particles are illustrated in British Pat. No. 1,027,146, U.S. Pat. Nos. 3,505,068 and 4,444,877 and Japanese Patent Application No. 248469/83 (corresponding to Japanese Patent Application (OPI) No. 143331/85).

In addition, the silver halide particles of the present invention may comprise different silver halide compositions as bonded by means of an epitaxial bond, or may contain any other compounds than silver halides such as silver rhodanide or lead oxide. These emulsion particles are described in U.S. Pat. Nos. 4,094,684, 4,142,900 and 4,459,353, British Pat. No. 2,038,792, U.S. Pat. Nos. 4,349,622, 4,395,478, 4,433,501, 4,463,087, 3,656,962 and 3,852,067, and Japanese Patent Application (OPI) No. 162540/84.

The silver halide particles to be used in the present invention may have a regular crystal appearance such as a cube, octahedron, dodecahedron or tetradecahedron or may be nearly spherical particles, or as the case may be, may comprise various particles of regular or irregular crystals.

The silver halide emulsion to be used in the present invention comprises silver halide particles as regulated to have a ratio of $\sigma\bar{d}$ of 0.2 or less, where $\sigma$ means a statistical standard deviation in the particle size distribution and $\bar{d}$ means an average particle diameter. More preferably, said ratio is 0.15 or less, and particularly preferably 0.12 or less. The average particle diameter of the silver halide particles herein used is based on the particle diameter of said particles in the case when these are spherical or nearly spherical, and in the other cases, this is based on the particle diameter as calculated on the basis of the projected area of said particles. In the present invention, said average particle diameter preferably falls within the range of 0.1 to 2 μm, particularly preferably within the range of 0.15 to 1 μm.

The standard deviation ($\sigma$) and the average particle diameter ($\bar{d}$) are represented by the following formulae, respectively:

$$\sigma=[\Sigma(\bar{d}-di)^2 ni/\Sigma ni]^{\frac{1}{2}}$$

$$\bar{d}=\Sigma dini/\Sigma ni$$

wherein "di" means a diameter of the aforesaid spherical or nearly spherical particle in the "i"th class when the particle size of the particles is classified into "m" groups; and "ni" means the number of the particles in the "i"th class.

The above ranges designate those of the individual silver halide particles before the admixture thereof.

Metal ions belonging to Ib, IIb, IVb and VIII groups in the Periodic Table (for example, metal ions belonging to Ib group such as copper, gold, etc.; metal ions belongint to IIb group such as zinc, cadmium, mercury, etc.; metal ions belonging to IVb group such as lead, etc.; and metal ions belonging to VIII group such as rhoduim, palladium, iridium, platinum, etc.) may be incorporated into the silver halide emulsions to be used in the present invention during the formation of the particles thereof.

The silver halide emulsions are, after the formation of the particles thereof, generally physically ripened, desalted and chemically ripened and thereafter coated on a support in the formation of the photographic materials of the present invention.

The silver halide emulsions to be used in the present invention may be subjected to chemical sensitization, such as sulfur or selenium sensitization, reduction sensitization or noble metal sensitization or a combination thereof.

For instance, various known methods may be used for the chemical sensitization, including a sulfur sensitization method in which a sulfur-containing compound capable of reacting with an active gelatin and silver (such as a thiosulfate, a thiourea, a mercapto compound, a rhodanine compound) is used; a reduction sensitization method in which a reducing substance (such as a stannous salt, an amine compound, a hydrazine derivative, a formamidine sulfinic acid, a silane compound) is used; and a noble metal sensitization method in which a metal compound (such as a gold complex or a Pt, Ir, Pd, Rh, Fe or other group VIII metal complex) is used. Said sensitization method may be used singly or in the form of a combination of plural kinds of methods. In the sensitization of the present silver halide emulsions according to said methods, a stabilizer such as a nucleic acid or a decomposed product thereof or a purine nucleus- or pyrimidine nucleus-containing compound or hydroxytetraazaindene may optionally be used.

The photographic emulsions to be used in the present invention may be spectrally sensitized with sensitizing dyes. Dyes which may be used for said spectral sensitization include cyanine dyes, merocyanine dyes, complex cyanine dyes, complex merocyanine dyes, holopolar cyanine dyes, hemicyanine dyes, styryl dyes and hemioxonol dyes. Particularly preferred dyes are cyanine dyes, merocyanine dyes and complex merocyanine dyes. These dyes may contain any and every conventional basic heterocyclic nucleus, which is generally contained in conventional cyanine dyes, including a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; alicyclic hydrocarbon ring-condensed nuclei of said nuclei; and aromatic hydrocarbon ring-condensed nuclei of said nuclei, such an an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a naphthoimidazole nucleus, a quinoline nucleus, an imidazo[4,5-b]quinoxaline nucleus, etc. These nuclei may optionally have substituent(s) on their carbon atom(s).

Merocyanine dyes and complex merocyanine dyes may contain a ketomethylene structural nucleus, such as a 5- or 6-membered heterocyclic nucleus or a pyrazolin-5-one nucleus, a thiohydantoin nucleus, a 2-thiooxazolidine-2, 4-dione nucleus, a thiazolidine-2,4-dione nucleus, a rhodanine nucleus, a thiobarbituric acid nucleus, a 2-thioselenazolidine-2,4-dione nucleus, a pyrazolo[1,5-a]benzimidazole nucleus, a pyrazolo[5,1-b]-quinazolone nucleus, etc.

Said sensitizing dyes may be used singly, or may be used in the form of a combination of two or more of said sensitizing dyes. The combination use of said sensitizing dyes is often utilized for the purpose of supersensitization.

The photographic emulsions of the present invention may further contain, together with said sensitizing dye, a dye which per se does not have any spectral sensitization activity but has a supersensitization activity, or a substance which does not substantially absorb any visible rays but has a supersensitization activity. For example, the present emulsions may contain aminostilbene compounds substituted by a nitrogen-containing heterocyclic group (for example, as described in U.S. Pat. Nos. 2,933,390 and 3,635,721), an aromatic organic acid/formaldehyde condensation product (for example, as described in U.S. Pat. No. 3,743,510), a cadmium salt, an azaindene compound, etc. In particular, the combinations as described in U.S. Pat. Nos. 3,615,613, 3,615,641, 3,617,295 and 3,635,721 are particularly preferred.

Various kinds of compounds may be incorporated into the photographic emulsions to be used in the present invention for the purpose of prevention of fog or of stabilization of the photographic characteristics of the photographic materials during the formation, preservation or photographic treatment of said materials. For instance, various kinds of known antifoggants or stabilizers may be used therefor, including azoles such as benzothiazolium salts, benzimidazolium salts, imidazoles, benzimidazoles (preferably 5-nitrobenzimidazoles), nitroindazoles, benzotriazoles (preferably 5-methylbenzotriazoles), triazoles; mercapto compounds such as mercaptothiazoles, mercaptobenzothiazoles, mercaptobenzimidazoles, mercaptobenzoxazoles, mercaptooxadiazoles, mercaptothiadiazoles (particularly 2-amino-5-mercapto-1,3,4-thiadiazoles), mercaptotriazoles, mercaptotetrazoles (particularly 1-phenyl-5-mercaptotetrazole), mercaptopyrimidines, mercaptotriazines; thiocarbonyl compounds such as oxazolinethiones; azaindenes such as triazaindenes, tetraazaindenes (particularly 4-hydroxy-6-methyl-(1,3,3a, 7) tetraazaindene), pentaazaindenes; benzenethiosulfonic acids, benzenesulfinic acids, benzenesulfonic acid amides; purines such as adenine, etc.

More detailed examples of said antifoggants or stabilizers and the methods for the use thereof are described, for example, in U.S. Patents 3,954,474 and 3,982,947, Japanese Patent Publication No. 28660/77, *Research Disclosure* (hereinafter referred to as "RD") No. 17643 (December, 1978), VIA through VIM and *Stabilization of Photographic Silver Halide Emulsions* (written by E. J. Birr and published by Focal Press in 1974).

The preparation of the monodispersed silver halide emulsions each having a different sensitivity to be used in the present invention and the admixture thereof are not specifically limitative. For instance, various means may be used therefor, including a method where two or more kinds of monodispersed silver halide emulsions each having a different average particle size are individually subjected to optimum chemical sensitization and then to spectral sensitization and the thus sensitized emulsions are blended, or alternatively, after the emulsions are chemically sensitized, these are blended and then subjected to spectral sensitization; a method where two or more kinds of monodispersed silver halide emulsions each having the same average particle size but having a different degree of chemical sensitization are blended, the degree of the chemical sensitization being modified by the variation of the addition time or the addition amount of a stabilizer such as hydroxytetraazaindene; or a method where two or more kinds of monodipsersed silver halide emulsions each having a different sensitivity are blended, the differentiation of the sensitivity resulting from the variation of the amount of the metal ion as contained in the silver halide particles.

In the mixture of two or more kinds of monodispersed silver halide emulsions, the difference in the sensitivity between the silver halide emulsion of the highest sensitivity and the silver halide emulsion of the lowest sensitivity is preferably 0.1 to 0.6 log E, especially preferably 0.2 to 0.5 log E. In this sentence, "E" means an exposure amount, and "the difference in the sensitivity ($\Delta$ log E)" means the difference in logarithms of exposure amounts, that is, $\log E_1 - \log E_2$, wherein $\log E_1$ is logarithm of an exposure amount necessary for obtaining an image density of minimum image density ($D_{min}$)+0.5 in a characteristic curve of a certain emulsion and $\log E_2$ is logarithm of an exposure amount necessary for obtaining an image density of minimum image density +0.5 in a characteristic curve of another emulsion. If said difference is smaller than the lowest limit of said range, the contrast of the gradation of the image formed will in general become higher, but, on the contrary, if said difference is larger than the highest limit of said range, the contrast of the gradation of the image formed will in general become lower. Such higher contrast and lower contrast are disadvantageous in the present invention. Regarding the admixture ratio of said monodispersed silver halide emulsion, it is preferred that 10 to 60% of said emulsions are those of the highest sensitivity and the remaining 90 to 40% are those of lower sensitivity.

If the content of the present silver halide emulsions of the highest sensitivity exceeds the upper limit of said range or is smaller than the lower limit thereof, the gradation of the image formed is often hard to regulate.

The coupler of the present invention may be incorporated in the photographic material in accordance with various known dispersion methods such as a solid dispersion method or an alkali dispersion method. In particular, a latex dispersion method is preferred, and an oil-in-water dispersion method is more preferred, which are representative means. In said oil-in-water dispersion method, the coupler is first dissolved in a single solution comprising either an organic solvent having a high boiling point of 175° C. or higher or a solvent having a low boiling point (that is, a so-called auxiliary solvent) or in a mixture solution comprising the combination of both of said solvents; and then, the resulting solution is finely dispersed in an aqueous medium such as water of a gelatin aqueous solution in the presence of a surfactant. Examples of high boiling point organic solvents are described in U.S. Pat. No. 2,322,027, etc. The dispersion may be accompanied by phase inversion. If necessary, the used auxiliary solvent may be removed or reduced by distillation, noodle washing or ultrafiltration and thereafter the obtained coupler dispersion may be coated on a support.

Examples of high boiling point organic solvents are phthalates (such as dibutyl phthalate, dicyclohexyl phthalate, di-2-ethylhexyl phthalate, decyl phthalate, etc.), phosphates and phosphonates (such as triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphonate, etc.), benzoates (such as 2-ethylhexyl benzoate, dodecyl benzoate, 2-ethylhexyl-p-hydroxy benzoate, etc.), amides (such as diethyldodecanamide, N-tetradecylpyrrolidone, etc.), alcohols and phenols (such as isostearyl alcohol, 2,4-di-tert-amylphenol, etc.), aliphatic carboxylates (such as dioctyl azelate, glycerol tributyrate, isostearyl lactate, trioctyl citrate, etc.), aniline derivatives (such as N,N-dibutyl-2-butoxy-5-tert-octylaniline, etc.), hydrocarbons (such as paraffin, dodecylbenzene, diisopropylnaphthalene, etc.), etc. As the auxiliary solvent may be used organic solvents having a boiling point of about 30° C. or higher, preferably 50° to about 160° C. or so, and representative examples thereof are ethyl acetate, butyl acetate, ethyl propionate, ethyl methyl ketone, cyclohexanone, 2-ethoxyethyl acetate, dimethylformamide, etc.

The procedure of the latex dispersion method and the effect thereof as well as examples of latexes to be used for immersion in said method are described in U.S. Pat. No. 4,199,363 and West German Patent Application (OLS) Nos. 2,541,274 and 2,541,230.

The photographic materials of the present invention may further contain various additives in addition to the aforesaid additives. Typical examples of additives which may be incorporated in the photographic materials of the present invention are described, for example, in RD No. 17643 (December, 1978) and No. 18716 (November, 1979). The relevant parts in these publications are listed in the following Table.

| No. | Kinds of Additives | RD 17643 | RD 18716 |
|---|---|---|---|
| 1 | Chemical sensitizer | p. 23 | p. 648, right column |
| 2 | Sensitivity intensifier | — | " |
| 3 | Spectral sensitizer<br>Supersensitizer | pp. 23–24 | from p. 648, right column to p. 649, right column |
| 4 | Antifoggant<br>Stabilizer | pp. 24–25 | p.649, right column |
| 5 | Light absorbent<br>Filter dye<br>UV absorbent | pp. 25–26 | from p. 649, right column to p. 650, left column |
| 6 | Stain inhibitor | p. 25, right column | p. 650, left to right column |
| 7 | Hardener | p. 26 | p. 651, left column |
| 8 | Binder | " | " |
| 9 | Plasticizer, Lubricant | p. 27 | p. 650, right column |
| 10 | Coating aid, Surfactant | pp. 26–27 | " |
| 11 | Antistatic agent | p. 27 | " |

The photographic materials of the present invention preferably have a protective layer, an intermediate layer, a filter layer, an antihalation layer, a backing layer, a white reflective layer or the like auxiliary layers, in addition to the silver halide emulsion layers.

Various kinds of color couplers may be incorporated in the photographic materials of the present invention, and concrete examples thereof are described in patent publications as referred to in the aforesaid RD No. 17643, VII-C through VII-G. In particular, couplers capable of forming three primary colors in subtractive color process (that is, yellow, magenta and cyan) are important as the dye-forming couplers to be used in the present photographic materials.

Supports which may properly be used in the photographic materials of the present invention are described, for example, in the aforesaid RD No. 17643, page 28 and RD No. 18716, from page 647, right hand column to page 648, left hand column.

The color photographic materials of the present invention may be developed in a conventional manner, for example, as described in the aforesaid RD No. 17643, pp. 28-29 and RD No. 18716, page 651, left to right hand column.

The color photographic materials of the present invention are, after being subjected to development followed by bleaching-fixation or fixation, washed with water or subjected to stabilization in a conventional manner.

The present invention may be applied to various kinds of color photographic materials. One typical example is a color paper. In addition, the present invention may also be applied to black-and-white photographic materials by admixture of three color couplers, as described, for example, in RD No. 17123 (July, 1978).

As explained in detail in the above description, the silver halide color photographic materials of the present invention have extreme effects in that the magenta color image absorption characteristic is good and that the color reproductivity is good. In addition, the silver halide color photographic materials of the present invention may form excellent color images of high color reproduction and tone reproduction, since the gradation regulation is easy and silver halide emulsion layers of desired gradation may properly be incorporated in the photographic materials.

The present invention will be explained in greater detail by reference to the following examples, which, however, are not intended to be interpreted as limiting the scope of the present invention.

Unless otherwise specified, all percents, ratios, etc., are by weight.

EXAMPLE 1

Layers shown in Table 1 as given below were provided on a paper support, both sides of which were laminated with polyethylene, to form a multilayer color photographic paper. Coating solutions were prepared as follows:

Preparation of the coating solution for the first layer:

10 ml of ethyl acetate and 1.4 ml of Solvent (c) were added to 10 g of Yellow Coupler (a) and 2.1 g of Color Image Stabilizer (b) and dissolved, and the resulting solution was emulsified and dispersed in 90 ml of 10% gelatin aqueous solution containing 10 ml of 1% sodium dodecylbenzenesulfonate. On the other hand, a blue-sensitive dye as shown below was added to a silver bromochloride emulsion (containing 85 mol % of silver bromide, and 70 g/kg of Ag), in an amount of $2.25\times10^{-4}$ mol per mol of said silver bromochloride, to form 95 g of a blue-sensitive emulsion. Said emulsion dispersion and said emulsion were blended and dissolved, and gelatin was added thereto to adjust the composition and the concentration of the resulting solution as shown in Table 1 to obtain the coating solution for the first layer.

In the same manner as the preparation of the first layer coating solution, the other coating solutions for the second to seventh layers were prepared. Sodium 1-oxy-3,5-dichloro-s-triazine was used as the gelatin hardener in each layer. The following spectral sensitizers were used in each emulsion layer.

The following dyes were used as the irradiation preventive dye in each emulsion layer.

Green-Sensitive Emulsion Layer:

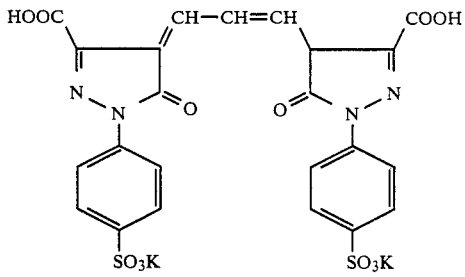

Red-Sensitive Emulsion Layer:

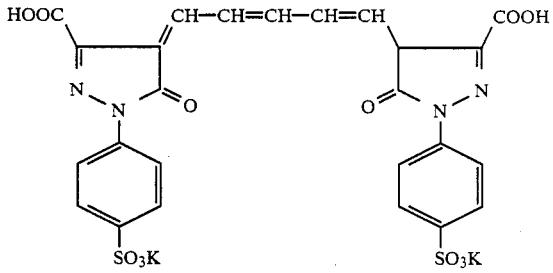

Structural formulae of the couplers or other compounds used in the present Example are given below.

Blue-Sensitive Emulsion Layer:

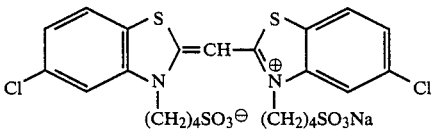

Green-Sensitive Emulsion Layer:

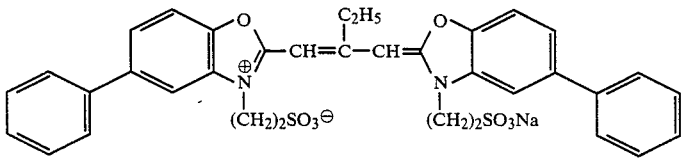

Red-Sensitive Emulsion Layer:

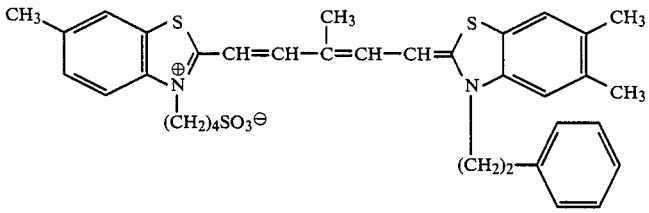

(a) Yellow Coupler:

-continued
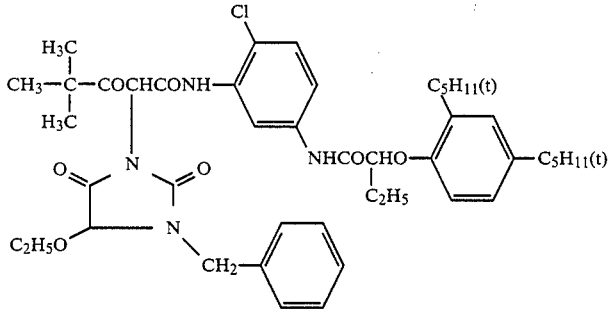
(b) Color Image Stabilizer:
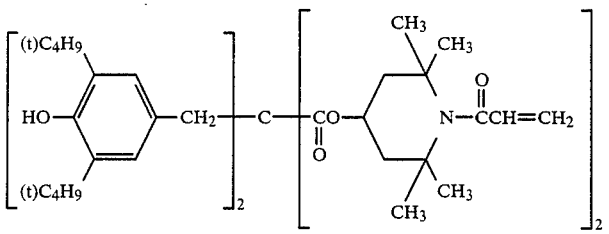
(c) Solvent:
$(C_9H_{19}O)_3P{=}O$
(d) Color Stain Inhibitor:
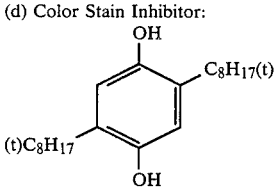
(e) Solvent:
Mixture (1:1, by volume) of 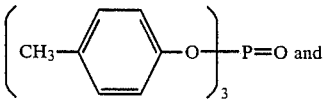 and
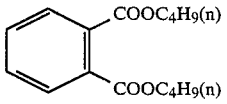
(f) Magenta Coupler:
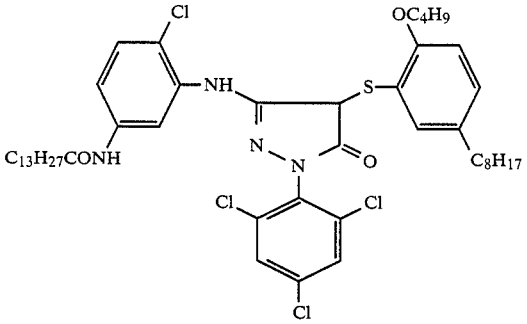
(g) Color Image Stabilizer:
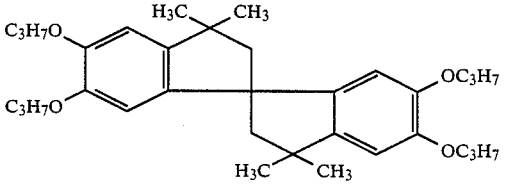

-continued
(h) Solvent:
$(C_8H_{17}O)_3P{=}O$
(i) UV Absorbent:
Mixture (1:5:3, by molar ratio) of
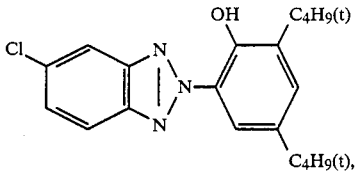
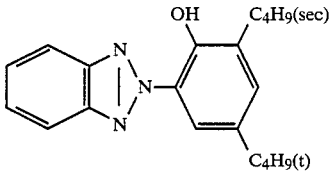
and
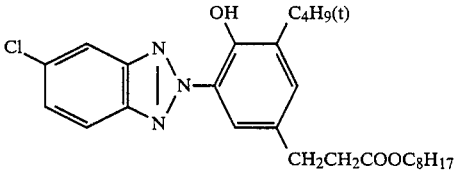
(j) Cyan Coupler:
Mixture (1:1, by molar ratio) of
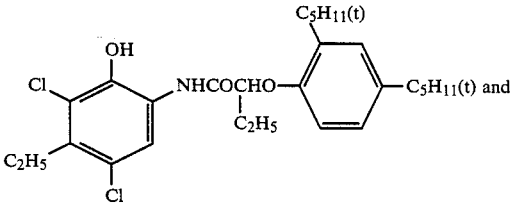
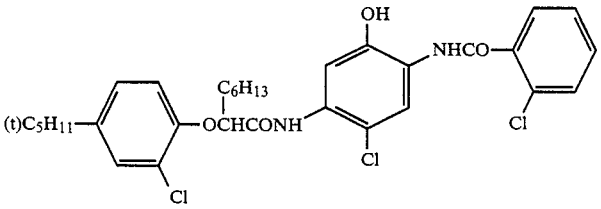
(k) Color Image Stabilizer:
Mixture (1:3:3, by molar ratio) of
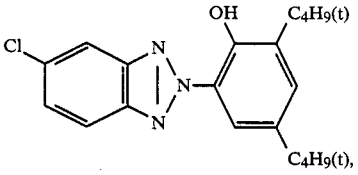
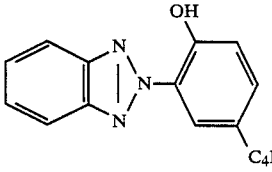
and -continued

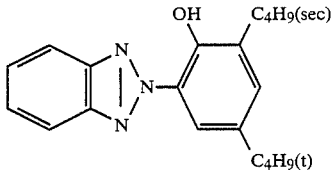

(l) Solvent:
Mixture (1:2, by molar ratio) of

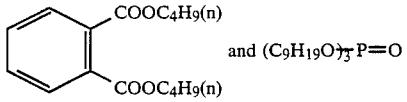

The balance of the surface tension and the viscosity of each of the coating solutions of the first to seventh layers were properly regulated, and then these were simultaneously coated on a support to obtain a multi-layer color silver halide photographic material.

TABLE 1

| | |
|---|---|
| Seventh Layer: Protective Layer | |
| Gelatin | 1.33 g/m$^2$ |
| Sixth Layer: UV Absorbent Layer | |
| Gelatin | 0.62 g/m$^2$ |
| UV Absorbent (i) | 5.10 × 10$^{-4}$ mol/m$^2$ |
| Solvent (c) | 0.07 g/m$^2$ |
| Fifth Layer: Red-Sensitive Layer | |
| Silver bromochloride emulsion (silver bromide: 50 mol %) | silver 0.22 g/m$^2$ |
| Gelatin | 0.93 g/m$^2$ |
| Cyan Coupler (j) | 7.05 × 10$^{-4}$ mol/m$^2$ |
| Color Image Stabilizer (k) | 5.20 × 10$^{-4}$ mol/m$^2$ |
| Solvent (l) | 0.25 g/m$^2$ |
| Fourth Layer: UV Absorbent Layer | |
| Gelatin | 1.43 g/m$^2$ |
| UV Absorbent (i) | 1.50 × 10$^{-3}$ mol/m$^2$ |
| Color Stain Inhibitor (d) | 1.50 × 10$^{-4}$ mol/m$^2$ |
| Solvent (c) | 0.22 g/m$^2$ |
| Third Layer: Green-Sensitive Layer | |
| Silver bromochloride emulsion (silver bromide: 70 mol %) | Silver 0.21 g/m$^2$ |
| Gelatin | 1.03 g/m$^2$ |
| Magenta Coupler (f) | 4.20 × 10$^{-4}$ mol/m$^2$ |
| Color Image Stabilizer (g) | 2.10 × 10$^{-4}$ mol/m$^2$ |
| Solvent (h) | 0.25 g/m$^2$ |
| Second Layer: Color Stain Preventive Layer | |
| Gelatin | 0.92 g/m$^2$ |
| Color Stain Inhibitor (d) | 2.33 × 10$^{-4}$ mol/m$^2$ |
| Solvent (e) | 0.15 g/m$^2$ |
| First Layer: Blue-Sensitive Layer | |
| Silver bromochloride emulsion (silver bromide: 85 mol %) | Silver 0.38 g/m$^2$ |
| Gelatin | 1.41 g/m$^2$ |
| Yellow Coupler (a) | 7.22 × 10$^{-4}$ mol/m$^2$ |
| Color Image Stabilizer (b) | 1.35 × 10$^{-4}$ mol/m$^2$ |
| Solvent (c) | 0.08 g/m$^2$ |

Support: Polyethylene laminated paper containing a white pigment (e.g., $TiO_2$) and a blue dye (e.g., ultramarine) in the side of the first layer.

In the third layer in the aforesaid Table 1, magenta coupler and the silver bromochloride emulsion were combined as shown in the following Table 2 to obtain Samples (A) through (G).

TABLE 2

| | Sample | | | | | | |
|---|---|---|---|---|---|---|---|
| | (A) | (B) | (C) | (D) | (E) | (F) | (G) |
| Magenta Coupler | (M-39) | (M-33) | (M-53) | (M-39) | (M-39) | (f) | (f) |
| Silver Bromochloride Emulsion (silver bromide: 70 mol %) | (Em-1) 20% (Em-2) 80% | (Em-1) 20% (Em-2) 80% | (Em-1) 20% (Em-2) 80% | (Em-1) 100% | (Em-3) 100% | (Em-1) 20% (Em-2) 80% | (Em-3) 100% |
| Note | Present Sample | Present Sample | Present Sample | Comparative Sample | Comparative Sample | Comparative Sample | Comparative Sample |

(Em-1) was prepared as follows:

| | |
|---|---|
| (1-solution) | |
| $H_2O$ | 1,000 ml |
| NaCl | 5.5 g |
| Gelatin | 25 g |
| (2-solution) | 20 ml |
| 1N sulfuric Acid | |
| (3-solution) | 2 ml |
| Silver halide solvent of the following formula, in the form of a 1% solution | |

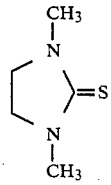

| | |
|---|---|
| (4-solution) | |
| KBr | 9.8 g |
| NaCl | 2.1 g |
| $H_2O$ to make | 250 ml |
| (5-solution) | |
| $AgNO_3$ | 20 g |
| $H_2O$ to make | 250 ml |
| (6-solution) | |
| KBr | 51.5 g |
| NaCl | 10.8 g |
| $K_2IrCl_6$ (0.001%) | 6 ml |
| $H_2O$ to make | 550 ml |
| (7-solution) | |
| $AgNO_3$ | 105 g |
| $H_2O$ to make | 550 ml |

(1-solution) was heated at 70° C., and (2-solution) and (3-solution) were added thereto. Next, (4-solution) and (5-solution) were simultaneously added thereto in the course of 12 minutes. After 5 minutes, (6-solution) and (7-solution) were further simultaneously added thereto in the course of 28 minutes. After 5 minutes from the addition, the temperature of the solution formed was lowered for desalting. Water and gelatin dispersion were added to the solution and the pH value thereof was adjusted to 6.2 to obtain a monodispersed cubic silver bromochloride emulsion having an average particle size of 0.5 μm ($\sigma/\bar{d}=0.13$) and containing 70 mol % of silver bromide. Sodium thiosulfate was added to the emulsion formed for the optimum chemical sensitization.

In the same manner as said emulsion (Em-1), with the exception that the addition period of the (4-solution) and (5-solution) was reduced to 6 minutes, another (Em-2) was prepared, which was a monodispersed cubic silver bromochloride emulsion having an average particle size of 0.3 μm ($\sigma/\bar{d}=0.12$) and containing 70 mol % of silver bromide. Sodium thiosulfate was added thereto for the optimum chemical sensitization. The sensitivity of (Em-2) was lower than that of (Em-1) by 0.28 (log E).

(Em-3) was prepared as follows:

| | |
|---|---|
| (8-solution) | |
| $H_2O$ | 1,000 ml |
| NaCl | 9.8 g |
| Gelatin | 28 g |
| (9-solution) | |
| 1N Sulfuric Acid | 20 ml |
| (10-solution) | |
| KBr | 18.9 g |
| NaCl | 4.5 g |
| $H_2O$ to make | 420 ml |
| (11-solution) | |
| $AgNO_3$ | 40 g |
| $H_2O$ to make | 420 ml |
| (12-solution) | |
| KBr | 46.9 g |
| NaCl | 21.7 g |
| $K_2IrCl_6$ (0.001%) | 6 ml |
| $H_2O$ to make | 420 ml |
| (13-solution) | |
| $AgNO_3$ | 100 g |
| $H_2O$ to make | 420 ml |

(8-solution) was heated at 70° C., and (9-solution) was added thereto. Next, (10-solution) and (11-solution) were simultaneously added thereto in the course of 3 minutes. After 3 minutes, (12-solution) and (13-solution) were further simultaneously added thereto in the course of 3 minutes. After 50 minutes from the addition, the temperature of the resulting solution was lowered for desalting. Water and gelatin dispersion were added to the solution and the pH value thereof was adjusted to 6.2 to obtain a silver bromochloride emulsion having an average particle size of 0.5 μm ($\sigma/\bar{d}=0.24$) and containing 70 mol % of silver bromide. Sodium thiosulfate was added to the emulsion formed for the optimum chemical sensitization.

Samples (A) through (G) were printed with a practically photographed and developed negative film, and these were treated in accordance with the following processing steps with the respective processing solutions to obtain practical prints.

| Processing Steps: Step | Temperature (°C.) | Period |
|---|---|---|
| Color Development | 33 | 1 min 30 sec<br>2 min 30 sec<br>3 min 30 sec |
| Bleach-Fixation | 33 | 1 min 30 sec |
| Water Washing | 33 | 3 min |

Compositions of Processing Solutions:

| | |
|---|---|
| Color Developer: | |
| Water | 800 ml |
| Sodium Tetrapolyphosphate | 2.0 g |
| Benzyl Alcohol | 14.0 ml |
| Diethylene Glycol | 10.0 ml |
| Sodium Sulfite | 2.0 g |
| Potassium Bromide | 0.5 g |
| Sodium Carbonate | 30.0 g |
| N—Ethyl-N—(β-methanesulfonamidoethyl)-3-methyl-4-aminoaniline Sulfonate | 5.0 g |
| Hydroxylamine Sulfate | 4.0 g |
| Water to make | 1,000 ml |
| pH (25° C.) | 10.20 |
| Bleach-Fixation Solution: | |
| Water | 400 ml |
| Ammonium Thiosulfate (70%) | 150 ml |
| Sodium Sulfite | 18 g |
| Ammonium Ethylenediaminetetraacetato Ferrate | 55 g |
| Disodium Ethylenediaminetetraacetate | 5 g |
| Water to make | 1,000 ml |
| pH (25° C.) | 7.00 |

Apart from said experiment, Samples (A) through (G) were exposed to light through an optical wedge and these were subjected to the aforesaid development processing to obtain color images of continuous gradation. The following Table 3 shows the characteristic values to express the gradation ($\bar{G}h$, $\bar{G}s$) of the images formed and the results of five point evaluation of the prints obtained by panelers (where 10 persons who were skilled in the art and could carry out the evaluation of photographic prints with a relatively high level were selected as the panelers).

The evaluation standards are as follows:

5: Excellent
4: Good
3: Normal
2: Bad
1: Extremely bad

From the results of Table 3, it is noted that Samples (A), (B) and (C) of the present invention are better than the other samples in both the color reproductivity and the tone reproductivity.

$\bar{G}h$ and $\bar{G}s$ are represented by the following formulae, respectively:

$$\bar{G}h=D_1/0.3$$

$$\bar{G}s=D_2/0.5$$

In said formulae, $D_1$ means a difference between "density of 0.8" and "density value obtainable by the exposure smaller than that necessary for obtaining the density of 0.8 by 0.3 (log E)" in the characteristic curve of the silver halide negative emulsion of Example 1; and $D_2$ means a difference between "density value obtainable by the exposure larger than that necessary for obtaining the density of 0.8 by 0.5 (log E)" and "density of 0.8" in the same characteristic curve.

TABLE 3

| Gradation of Samples and Evaluation of Practical Prints | | | Sample | | | | | | | | | | | | | |
|---|---|---|---|---|---|---|---|---|---|---|---|---|---|---|---|---|
| | | | Present Sample | | | | | | | | Comparative Sample | | | | | |
| | | | (A) | | (B) | | (C) | | (D) | | (E) | | (F) | | (G) | |
| Gradation | | | | | | | | | | | | | | | | |
| B | $\overline{Gh}$ | $\overline{Gs}$ | 2.05 | 2.22 | 2.01 | 2.22 | 2.03 | 2.18 | 2.01 | 2.20 | 2.10 | 2.22 | 2.01 | 2.18 | 2.05 | 2.20 |
| G | $\overline{Gh}$ | $\overline{Gs}$ | 1.08 | 2.54 | 1.08 | 2.54 | 1.80 | 2.56 | 1.93 | 3.28 | 1.90 | 2.54 | 1.80 | 2.56 | 1.90 | 2.56 |
| R | Gh | Gs | 2.10 | 3.22 | 2.08 | 3.22 | 2.08 | 3.22 | 2.10 | 3.24 | 2.10 | 3.24 | 2.10 | 3.22 | 2.12 | 3.22 |
| Evaluation by Panelers | | | | | | | | | | | | | | | | |
| (a) | Color reproduction | Tone reproduction | 4 | 4 | 5 | 4 | 5 | 5 | 2 | 2 | 4 | 3 | 3 | 5 | 4 | 3 |
| (b) | Color reproduction | Tone reproduction | 4 | 4 | 5 | 4 | 4 | 4 | 3 | 2 | 5 | 4 | 4 | 4 | 4 | 3 |
| (c) | Color reproduction | Tone reproduction | 5 | 4 | 4 | 4 | 5 | 5 | 2 | 2 | 4 | 3 | 4 | 5 | 3 | 3 |
| (d) | Color reproduction | Tone reproduction | 4 | 4 | 4 | 4 | 5 | 5 | 3 | 2 | 4 | 4 | 3 | 4 | 4 | 4 |
| (e) | Color reproduction | Tone reproduction | 5 | 4 | 4 | 4 | 4 | 4 | 3 | 1 | 4 | 3 | 3 | 5 | 3 | 4 |
| (f) | Color reproduction | Tone reproduction | 4 | 5 | 4 | 5 | 5 | 4 | 3 | 1 | 5 | 4 | 4 | 4 | 3 | 3 |
| (g) | Color reproduction | Tone reproduction | 4 | 5 | 5 | 5 | 4 | 5 | 3 | 2 | 4 | 4 | 3 | 4 | 3 | 3 |
| (h) | Color reproduction | Tone reproduction | 4 | 5 | 4 | 5 | 4 | 5 | 3 | 2 | 4 | 4 | 3 | 4 | 4 | 3 |
| (i) | Color reproduction | Tone reproduction | 4 | 5 | 4 | 5 | 5 | 5 | 2 | 1 | 4 | 4 | 3 | 4 | 3 | 3 |
| (j) | Color reproduction | Tone reproduction | 4 | 4 | 4 | 5 | 4 | 5 | 2 | 2 | 5 | 3 | 3 | 4 | 4 | 3 |
| Total | Color reproduction | Tone reproduction | 42 | 44 | 43 | 45 | 45 | 47 | 26 | 17 | 43 | 36 | 33 | 43 | 35 | 32 |

EXAMPLE 2

In the same manner as the aforesaid Example 1, with the exception that the Magenta Coupler (M-21) of the present invention (as listed hereinbefore) was used in combination with various kinds of a monodispersed silver bromochloride emulsion, Samples (H) through (M) were prepared. The following Table 4 shows said samples.

TABLE 4

| | Sample | | | | | |
|---|---|---|---|---|---|---|
| | (H) | (I) | (J) | (K) | (L) | (M) |
| Magenta Coupler | (M-21) | (M-21) | (M-21) | (M-21) | (M-21) | (M-21) |
| Silver Bromochloride Emulsion (silver bromide: 70 mol %) | (Em-1) 20% (Em-2) 80% | (Em-4) 40% (Em-5) 60% | (Em-1) 30% (Em-6) 70% | (Em-1) 100% | (Em-4) 100% | (Em-6) 100% |
| Remarks | Present Sample | Present Sample | Present Sample | Comparative Sample | Comparative Sample | Comparative Sample |

(Em-4) was prepared in the same manner as the aforesaid (Em-1), with the exception that the chemical sensitization was carried out with triethylthiourea and 4-hydroxy-6-methyl-1,3,3a, 7-tetraazaindene for the optimum sensitization.

(Em-5) was prepared in the same manner as said (Em-4) while the addition period of said 4-hydroxy-6-methyl-1,3,3a, 7-tetraazaindene in the chemical sensitization was varied, whereby a silver bromochloride emulsion having a lower sensitivity than said (Em-4) by 0.19 (log E) was obtained.

(Em-6) was prepared in the same manner as said (Em-1), with the exception that $1\times10^{-5}$ mol of rhodium (III) chloride.$4H_2O$ was added to (1-solution). This was a monodispersed cubic silver bromochloride emulsion having an average particle size of 0.5 $\mu$m ($\sigma/\bar{d}=0.14$). The sensitivity thereof was lower than that of (Em-1) by 0.25 (log E).

These Samples (H) through (M) were printed and developed in the same manner as in the aforesaid Example 1 to obtain practical prints. Apart from these prints, color images of continuous gradation were obtained also in the same manner as in Example 1.

The following Table 5 shows the characteristic values to express the gradation of the images formed and the results of evaluation of the prints obtained by 10 panelers. From the results of Table 5, it is noted that Samples (H), (I) and (J) of the present invention are better in both the color reproductivity and the tone reproductivity.

TABLE 5

Gradation of Samples and Evaluation of Practical Prints

| | | | Sample | | | | | | | | | | | |
|---|---|---|---|---|---|---|---|---|---|---|---|---|---|---|
| | | | Present Sample | | | | | | Comparative Sample | | | | | |
| | | | (H) | | (I) | | (J) | | (K) | | (L) | | (M) | |
| Gradation | | | | | | | | | | | | | | |
| B | $\overline{Gh}$ | $\overline{Gs}$ | 2.03 | 2.22 | 2.05 | 2.22 | 2.05 | 2.18 | 2.03 | 2.22 | 2.01 | 2.22 | 2.01 | 2.22 |
| G | $\overline{Gh}$ | $\overline{Gs}$ | 1.81 | 2.54 | 1.79 | 2.56 | 1.80 | 2.54 | 1.93 | 3.28 | 1.94 | 3.16 | 1.97 | 3.26 |
| R | $\overline{Gh}$ | $\overline{Gs}$ | 2.08 | 3.22 | 2.08 | 3.22 | 2.10 | 3.22 | 2.12 | 3.26 | 2.08 | 3.26 | 2.10 | 3.26 |
| Evaluation by Panelers | | | | | | | | | | | | | | |
| (a) | Color reproduction | Tone reproduction | 5 | 4 | 5 | 5 | 4 | 4 | 2 | 1 | 3 | 2 | 3 | 1 |
| (b) | Color reproduction | Tone reproduction | 4 | 5 | 5 | 4 | 4 | 5 | 3 | 1 | 3 | 1 | 3 | 2 |
| (c) | Color reproduction | Tone reproduction | 4 | 5 | 5 | 4 | 4 | 4 | 2 | 1 | 2 | 2 | 3 | 1 |
| (d) | Color reproduction | Tone reproduction | 4 | 4 | 4 | 5 | 5 | 5 | 3 | 1 | 3 | 2 | 3 | 1 |
| (e) | Color reproduction | Tone reproduction | 4 | 5 | 5 | 5 | 5 | 5 | 2 | 1 | 3 | 2 | 3 | 1 |
| (f) | Color reproduction | Tone reproduction | 5 | 4 | 4 | 4 | 4 | 4 | 2 | 2 | 3 | 1 | 3 | 1 |
| (g) | Color reproduction | Tone reproduction | 4 | 5 | 4 | 4 | 5 | 4 | 2 | 1 | 3 | 1 | 3 | 2 |
| (h) | Color reproduction | Tone reproduction | 4 | 4 | 5 | 4 | 5 | 5 | 3 | 2 | 3 | 1 | 2 | 2 |
| (i) | Color reproduction | Tone reproduction | 4 | 5 | 5 | 5 | 5 | 5 | 3 | 2 | 3 | 1 | 3 | 1 |
| (j) | Color reproduction | Tone reproduction | 5 | 5 | 5 | 4 | 4 | 4 | 3 | 1 | 3 | 2 | 3 | 1 |
| Total | Color reproduction | Tone reproduction | 43 | 46 | 47 | 44 | 45 | 45 | 25 | 13 | 29 | 15 | 29 | 13 |

EXAMPLE 3

In a manner analogous to that in the aforesaid Example 1, with exception that the combinations as shown in the following Table 6 were used, sample (N) was prepared.

TABLE 6

| | | |
|---|---|---|
| Seventh Layer: Protective Layer | | |
| Gelatin | | 1.33 g/m$^2$ |
| Acryl-modified copolymer of polyvinyl alcohol (degree of modification: 17%) | | 0.17 g/m$^2$ |
| Sixth Layer: UV Absorbent Layer | | |
| Gelatin | | 0.54 g/m$^2$ |
| UV Absorbent (i) | | 0.21 g/m$^2$ |
| Solvent (r) | | 0.09 ml/m$^2$ |
| Fifth Layer: Red-Sensitive Layer | | |
| (Em-11)/(Em-12) (weight ratio: 30/70) | Silver | 0.22 g/m$^2$ |
| Gelatin | | 0.90 g/m$^2$ |
| Cyan Coupler (u) | | 0.36 g/m$^2$ |
| Color Image Stabilizer (k) | | 0.17 g/m$^2$ |
| Solvent (t) | | 0.22 ml/m$^2$ |
| Fourth Layer: UV Absorbent Layer | | |
| Gelatin | | 1.60 g/m$^2$ |
| UV Absorbent (i) | | 0.62 g/m$^2$ |
| Color Stain Inhibitor (d) | | 0.05 g/m$^2$ |
| Solvent (r) | | 0.26 ml/m$^2$ |
| Third Layer: Green-Sensitive Layer | | |
| Gelatin | | 1.80 g/m$^2$ |
| Magenta Coupler (s) | | 0.38 g/m$^2$ |
| Color Image Stabilizer (g) | | 0.16 g/m$^2$ |
| Solvent (t) | | 0.38 ml/m$^2$ |
| Second Layer: Color Stain Preventive Layer | | |
| Gelatin | | 0.99 g/m$^2$ |
| Color Stain Inhibitor (d) | | 0.08 g/m$^2$ |
| Solvent (r) | | 0.26 ml/m$^2$ |
| First Layer: Blue-Sensitive Layer | | |
| (Em-7)/(Em-8) (weight ratio: 30/70) | Silver | 0.27 g/m$^2$ |
| Gelatin | | 1.86 g/m$^2$ |
| Yellow Coupler (p) | | 0.62 g/m$^2$ |
| Color Image Stabilizer (b) | | 0.19 g/m$^2$ |
| Solvent (q) | | 0.34 ml/m$^2$ |

Support: Polyethylene laminated paper containing a white pigment (e.g., $TiO_2$) and a blue dye (e.g., ultramarine) in the side of the first layer.

(Em-7) was prepared as follows:

| | |
|---|---|
| (14-solution) | |
| $H_2O$ | 1,000 ml |
| NaCl | 5.8 g |
| Gelatin | 25 g |
| (15-solution) | 20 ml |
| 1 N—sulfuric Acid | |
| (16-solution) | 3 ml |
| Silver halide solvent of the following formula, in the form of a 1% solution | |

TABLE 6-continued

| | | |
|---|---|---|
| (Em-9)/(Em-10) (weight ratio: 30/70) | Silver | 0.15 g/m$^2$ |

-continued

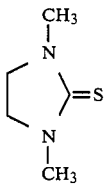

| | |
|---|---|
| (17-solution) | |
| KBr | 0.18 g |
| NaCl | 8.51 g |
| $H_2O$ to make | 130 ml |
| (18-solution) | |
| $AgNO_3$ | 25 g |
| $H_2O$ to make | 130 ml |
| (19-solution) | 28 ml |
| $Pb(CH_3COO)_2$ (0.1%) | |
| (20-solution) | |
| KBr | 0.70 g |
| NaCl | 34.05 g |
| $H_2O$ to make | 285 ml |
| (21-solution) | |
| $AgNO_3$ | 100 g |
| $H_2O$ to make | 285 ml |

(14-solution) was heated at 60° C., and (15-solution) and (16-solution) were added thereto. Next, (17-solution) and (18-solution) were simultaneously added thereto in the course of 60 minutes. After 1 minute from the completion of addition of (17-solution) and (18-solution), (19-solution) was added thereto, and further after 9 minutes, (20-solution) and (21-solution) were simultaneously added thereto in the course of 25 minutes. After 5 minutes from the addition, the temperature of the formed solution was lowered for desalting. Water and gelatin dispersion were added to the solution and the pH value thereof was adjusted to 6.0, to obtain a monodispersed cubic silver bromochloride emulsion having an average particle size of 1.00 μm ($\sigma/\bar{d}=0.11$) and containing 1 mol % of silver bromide. Triethyl thiourea and auric chloride were added to the formed emulsion for the optimum chemical sensitization. After the completion of chemical sensitization, the spectral sensitizer (m) as shown below was added in an amount of $7\times10^{-4}$ mol per mol of the silver halide emulsion.

In the same manner as the emulsion (Em-7), with the exception that the addition period of the (17-solution) was reduced to 40 minutes, another (Em-8) was prepared.

In the same manner as above, with exception that the temperature, the addition period and the type and amount of spectral sensitizer were changed, (Em-9) and (Em-10) used in the green-sensitive layer and (Em-11) and (Em-12) used in the red-sensitive layer were prepared. The spectral sensitizer (n) used for (Em-9) and (Em-10) and the spectral sensitizer (o) used for (Em-11) and (Em-12) are shown below.

The average particle sizes of silver halide grains in (Em-7) to (Em-12), the ratios of $\sigma\bar{d}$ thereof and the halogen compositions thereof are shown in the following Table 7. The additives used other than the spectral sensitizers are also shown below.

(m) Spectral Sensitizer:

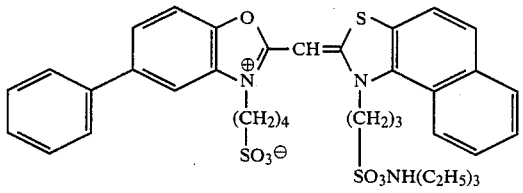

(Amount used: $7\times10^{-4}$ mol per mol of silver halide)

(n) Spectral Sensitizer:

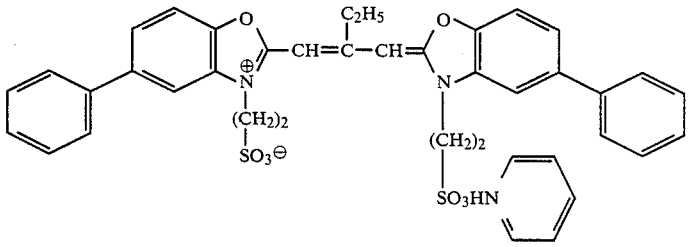

(Amount used: $4\times10^{-4}$ mol per mol of silver halide)

(o) Spectral Sensitizer:

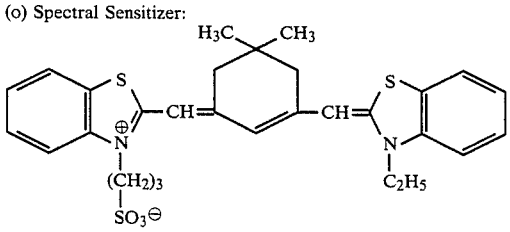

(Amount used: $2\times10^{-4}$ mol per mol of silver halide)

TABLE 7

| Emulsion | Average Particle Size (μm) | (σ/d̄) | Halogen Composition Br % | Cl % |
|---|---|---|---|---|
| (7) | 1.00 | 0.11 | 1.0 | 99.0 |
| (8) | 0.86 | 0.10 | 1.0 | 99.0 |
| (9) | 0.44 | 0.11 | 1.0 | 99.0 |
| (10) | 0.37 | 0.12 | 1.0 | 99.0 |
| (11) | 0.53 | 0.12 | 1.0 | 99.0 |
| (12) | 0.43 | 0.10 | 1.0 | 99.0 |

(p) Yellow Coupler:

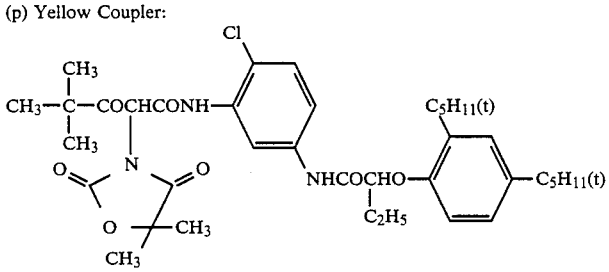

(q) Solvent:

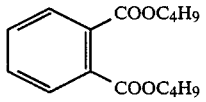

(r) Solvent:

(iso $C_9H_{19}O)_3P{=}O$ (s) Magenta Coupler:

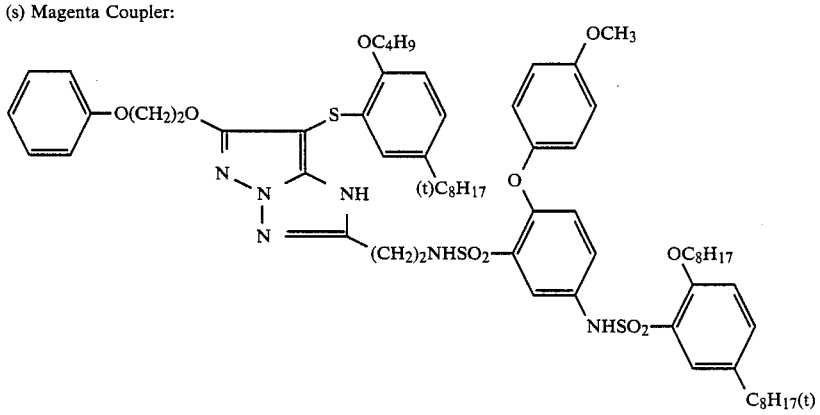

(t) Solvent:

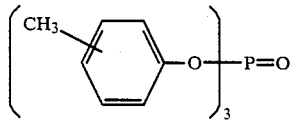

(u) Cyan Coupler:

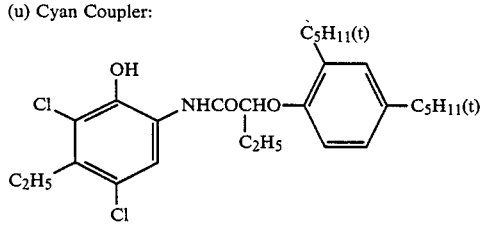

The color image stabilizer (b), color stain inhibitor (d), color image stabilizer (g), color image stabilizer (k) and UV absorbent (i) have the same structures as those used in the aforesaid Example 1.

The sample (N) was printed with a practically photographed and developed negative film, and processed in accordance with the following processing steps with the respective processing solutions, to obtain practical print.

| Processing Steps: Step | Temperature (°C.) | Period |
|---|---|---|
| Color Development (Composition B) | 35 | 45 sec |
| Bleach-Fixation (Composition B) | 35 | 45 sec |

-continued

| Rinsing | 28 to 35 | 1 min 30 sec |
|---|---|---|
| Compositions of Processing Solutions: | | |
| Composition B of Color Developer: | | |
| Water | | 800 ml |
| Penta-sodium Diethylenetriamine Pentaacetate | | 1.0 g |
| Sodium Sulfite | | 0.2 g |
| N,N—Diethylhydroxyl Amine | | 4.2 g |
| Potassium Bromide | | 0.01 g |
| Sodium Chloride | | 1.5 g |
| Triethanol Amine | | 8.0 g |
| N—ethyl-N—(β-methanesulfonamidoethyl)-3-methyl-4-aminoaniline.sulfonate | | 4.5 g |
| Potassium Carbonate | | 30.0 g |
| 4,4'-diaminostilbene-type Brightening Agent (Whitex 4 of Sumitomo Chemical Co., Ltd.) | | 2.0 g |
| Water to make | | 1,000 ml |
| pH | | 10.1 |
| Composition B of Bleach-Fixation Solution: | | |
| Water | | 700 ml |
| Ammonium Thiosulfate (54 wt %) | | 150 ml |
| Sodium Sulfite | | 15 g |
| Ammonium ethylenediaminetetraacetato Ferrate | | 55 g |
| Disodium Ethylenediaminetetraacetate (Dihydride) | | 4 g |
| Glacial Acetic Acid | | 8.61 g |
| Water to make | | 1,000 ml |
| pH | | 5.4 |
| Composition of Rinsing Solution: | | |
| Disodium Ethylenediaminetetraacetate (Dihydride) | | 0.4 g |
| Water to make | | 1,000 ml |
| pH | | 7.0 |

The practical print obtained with the sample (N) of the present invention was remarkably good in both the color-reproductivity and the tone-reproductivity.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a reflective support having thereon a silver halide emulsion layer containing a pyrazolotriazole-type magenta coupler of formula (II), (V) or (VI):

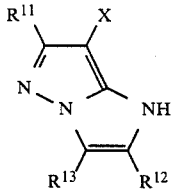

(II)

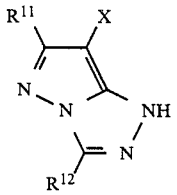

(V)

-continued

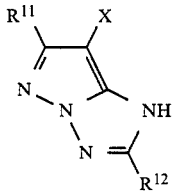

(VI)

wherein $R^{11}$, $R^{12}$ and $R^{13}$ may be the same or different and each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; X represents a hydrogen atom, a halogen atom, a carboxyl group or a group which is removable by coupling and which is bonded to the carbon atom in the coupling position via an oxygen atom, a nitrogen atom or a sulfur atom; and said $R^{11}$, $R^{12}$, $R^{13}$ or X may optionally be a divalent group to form a bis compound, or may be a vinyl group or a binding group to form a polymer; at least two monodispersed silver halide emulsions each having a different sensitivity being admixed and then incorporated into the above-said silver halide emulsion layer, said monodispersed silver halide emulsion being regulated to have a ratio of $\sigma/d$ or f0.2 or less, where $\sigma$ means a statistical standard deviation in the particle size distribution and d means an average particle diameter.

2. The silver halide color photographic material as claimed in claim 1, wherein $R^{11}$, $R^{12}$ or $R^{13}$ in said formula (II), (V) or (VI) represents a substituted or unsubstituted alkylene group, a substituted or unsubstituted phenylene group, an —NHCO— $R^{14}$—CONH— group (in which $R^{14}$ represents a substituted or unsubstituted alkylene or phenylene group), an —S—$R^{14}$—S— group (in which $R^{14}$ represents a substituted or unsubstituted alkylene group) to form a bis compound; and X in said formula (II), (V) or (VI) represents a divalent group corresponding to said monovalent groups of said substituent R's to form a bis compound.

3. The silver halide color photographic material as claimed in claim 1, wherein said pyrazoloazole-type magenta coupler is selected from the following group consisting of couplers (M-1), (M-2), (M-4) to (M-12), (M-14) to (M-45), (M-47), (M-49) and (M-51) to (M-54):

(M-1)
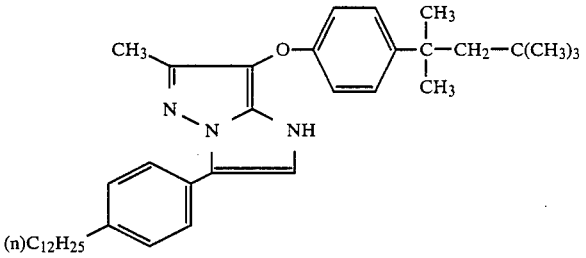
(M-2)
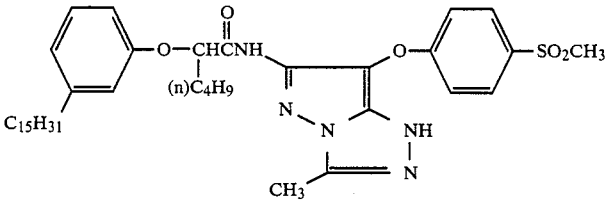
(M-4)
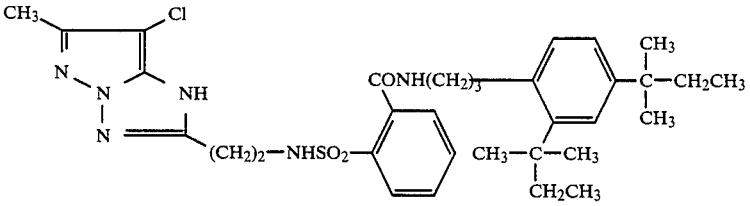
(M-5)
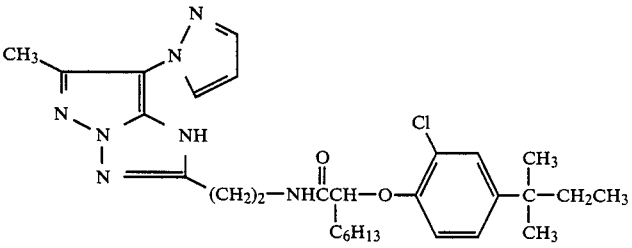
(M-6)
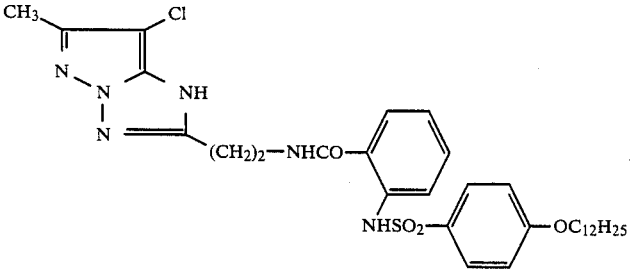
(M-7)
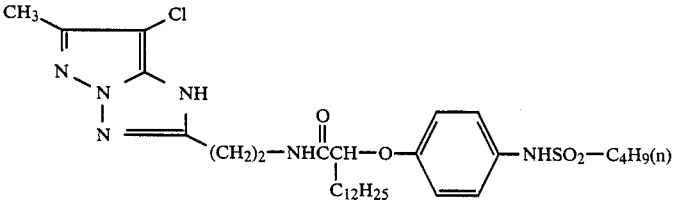

-continued
(M-8)
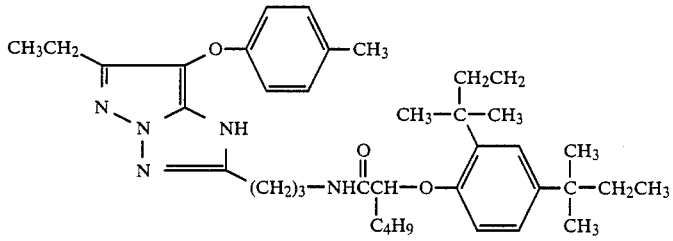
(M-9)
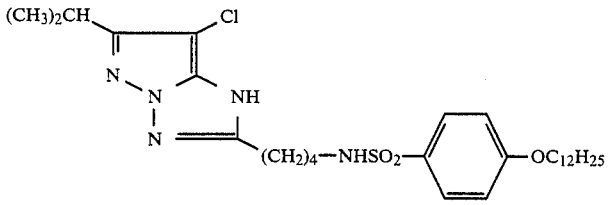
(M-10)
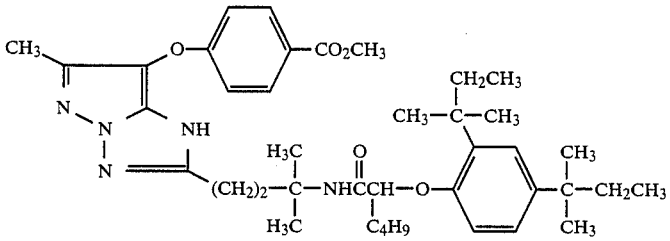
(M-11)
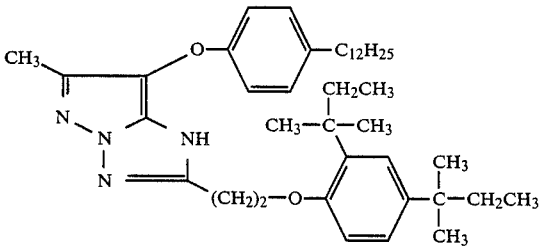
(M-12)
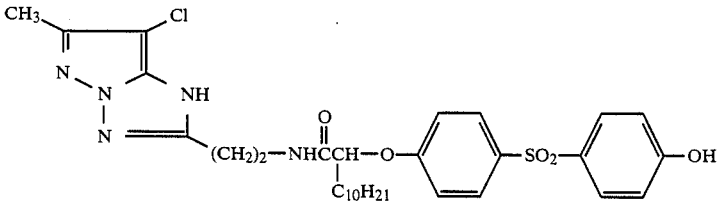
(M-14)
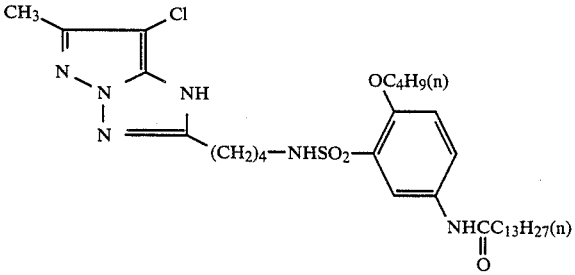

-continued
(M-15)
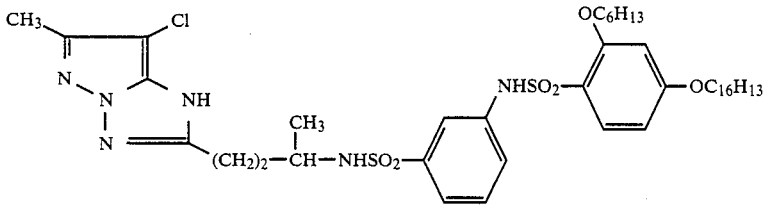
(M-16)
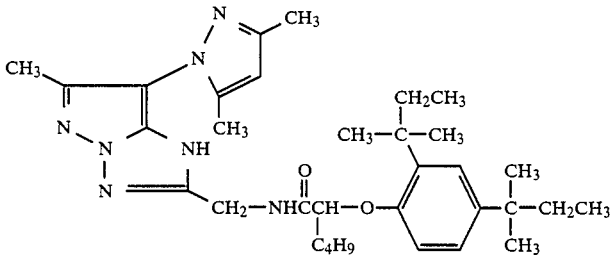
(M-17)
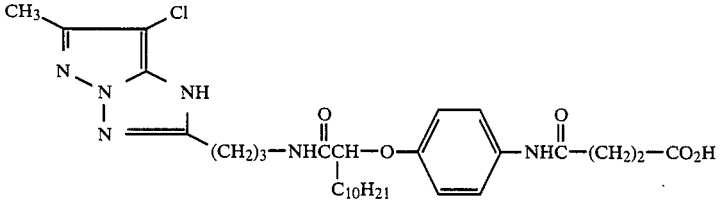
(M-18)
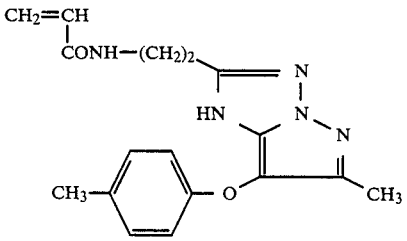
(M-19)
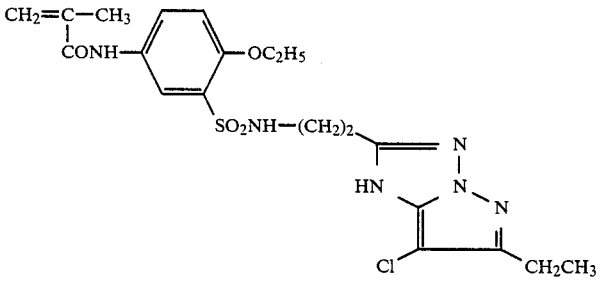
(M-20)
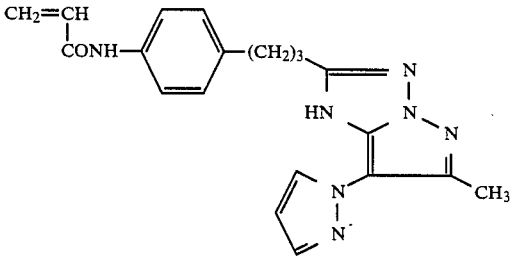

-continued
(M-21)
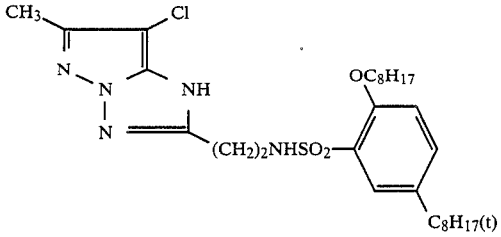
(M-22)
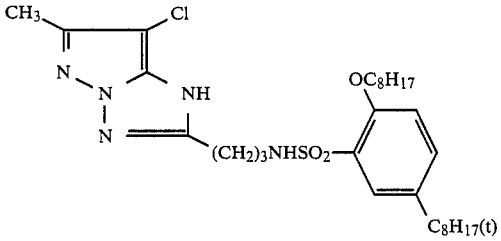
(M-23)
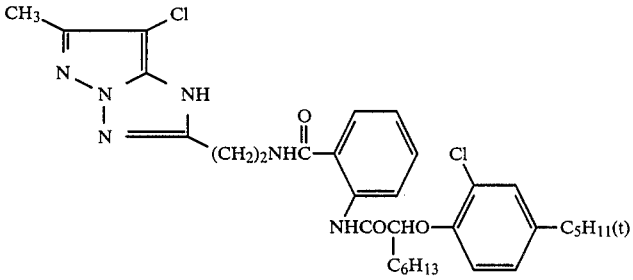
(M-24)
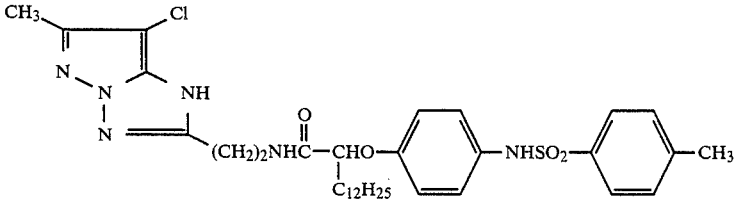
(M-25)
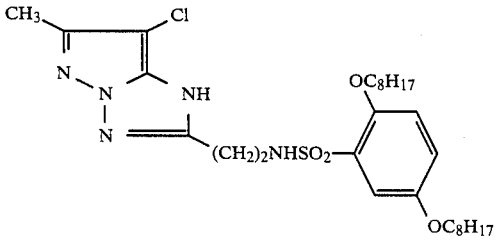
(M-26)
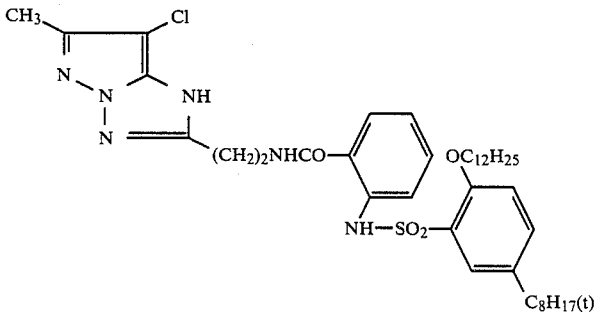

-continued
(M-27)
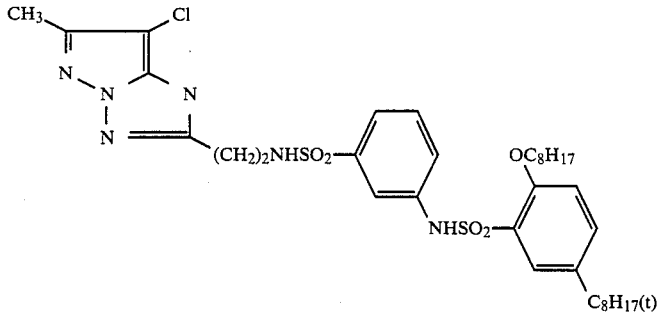
(M-28)
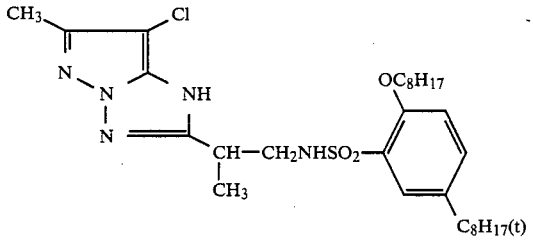
(M-29)
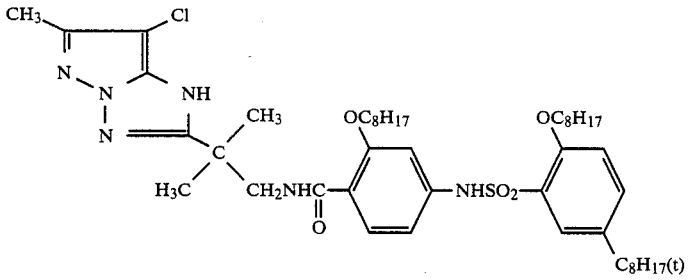
(M-30)
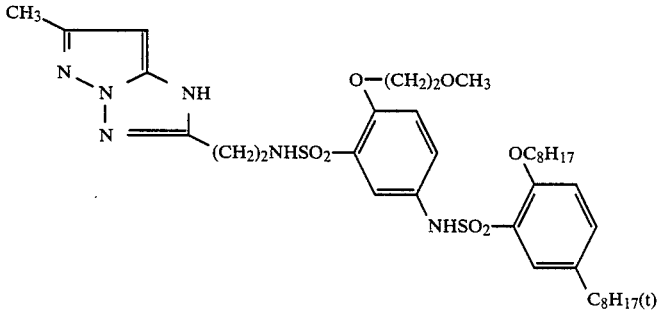
(M-31)
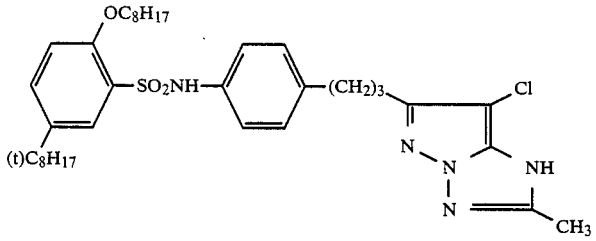
(M-32)
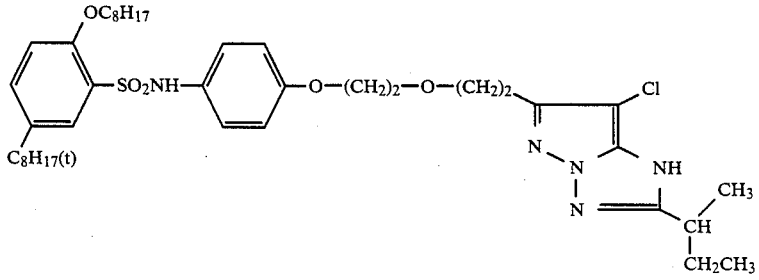

-continued
(M-33)
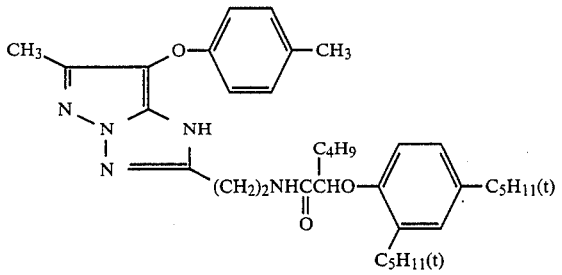
(M-34)
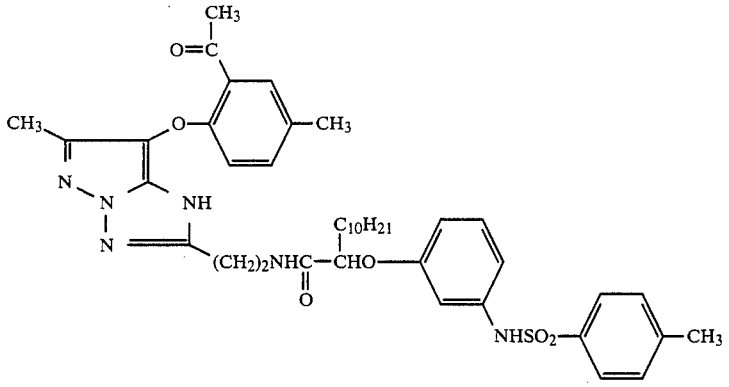
(M-35)
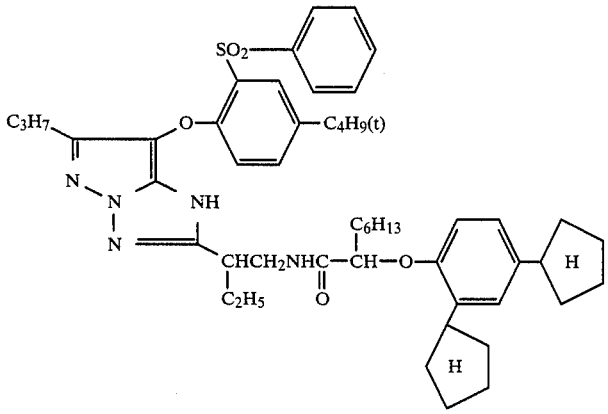
(M-36)
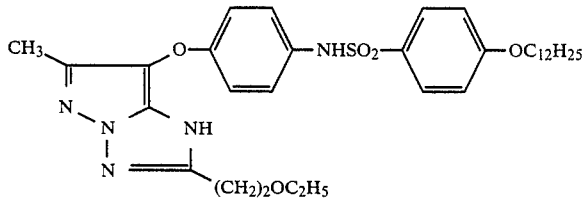
(M-37)
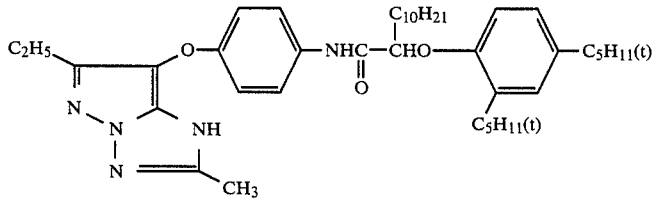

-continued
(M-38)
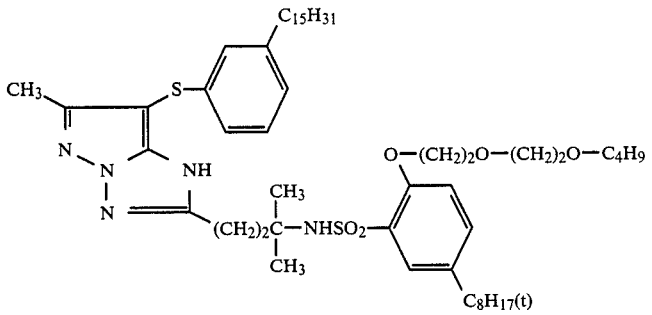
(M-39)
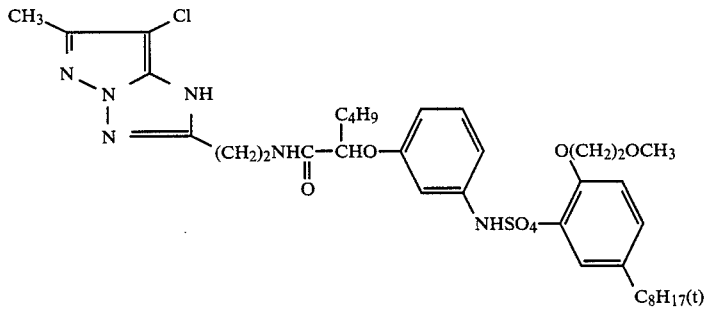
(M-40)
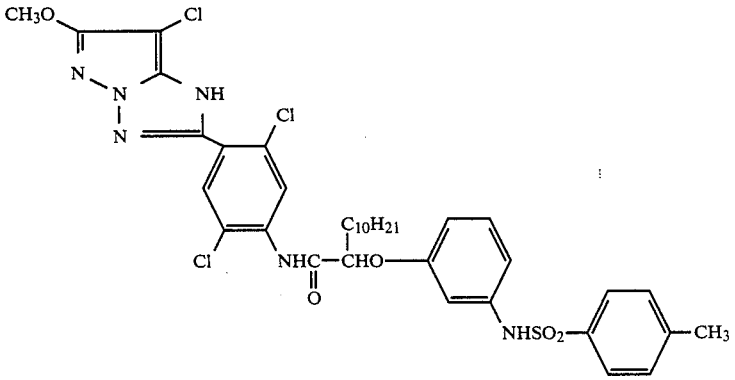
(M-41)
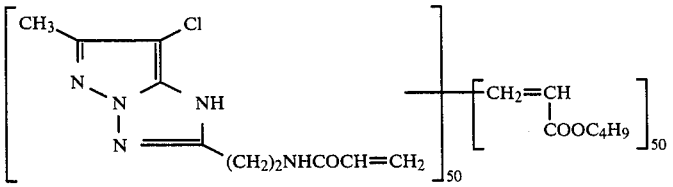
(M-42)
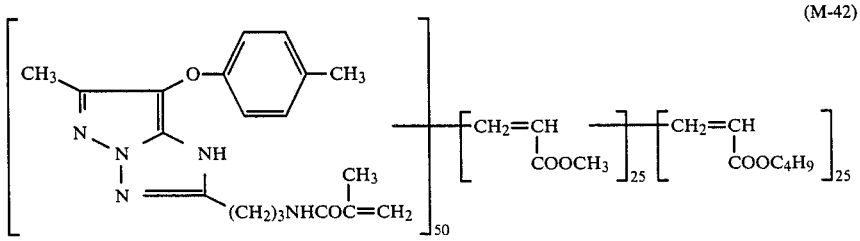

-continued
(M-43)
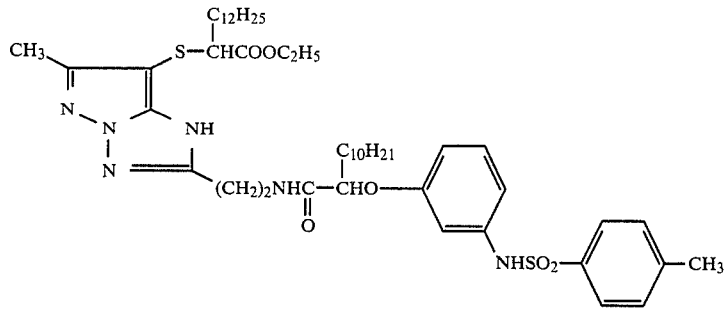
(M-44)
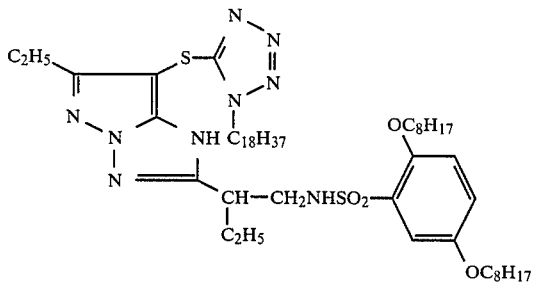
(M-45)
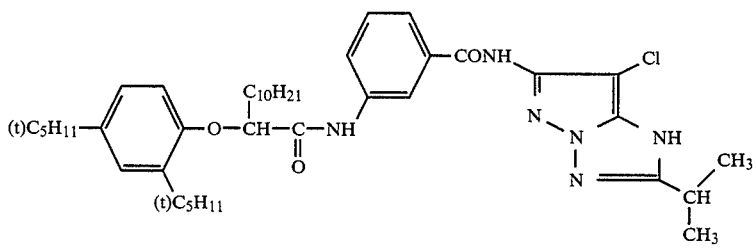
(M-46)
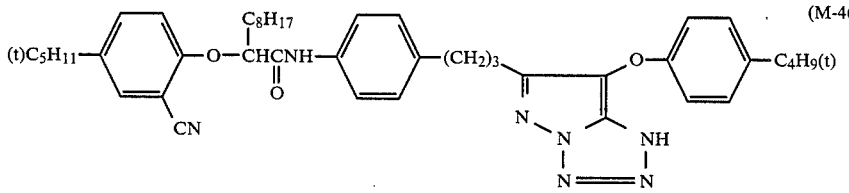
(M-47)
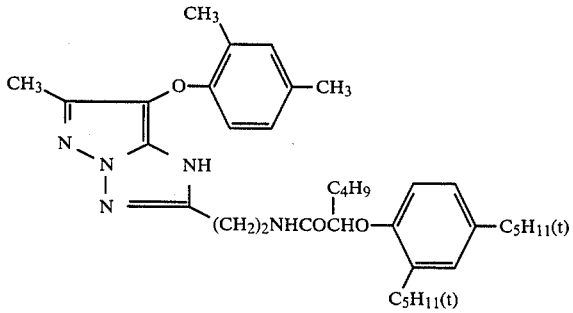
(M-49)
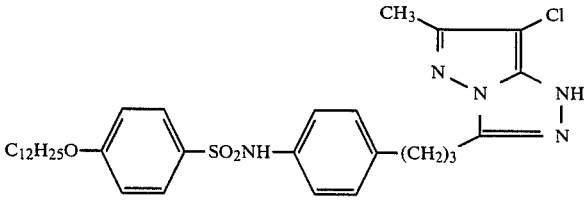

-continued (M-51)

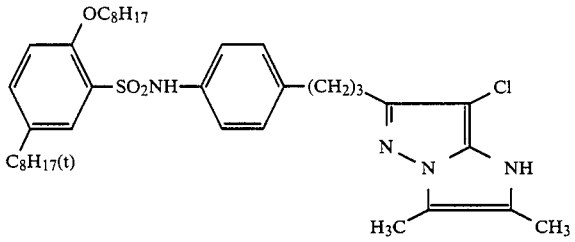

(M-52)

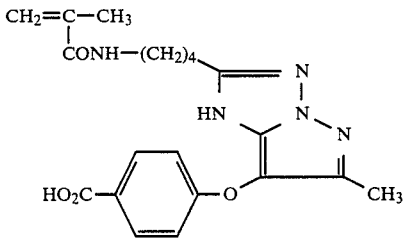

(M-53)

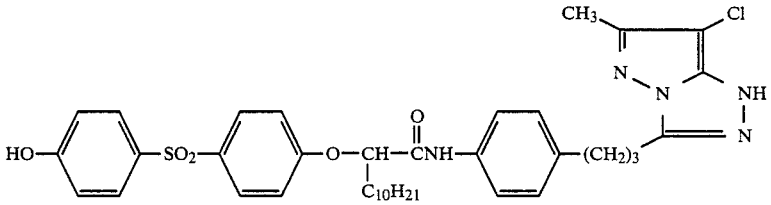

and (M-54)

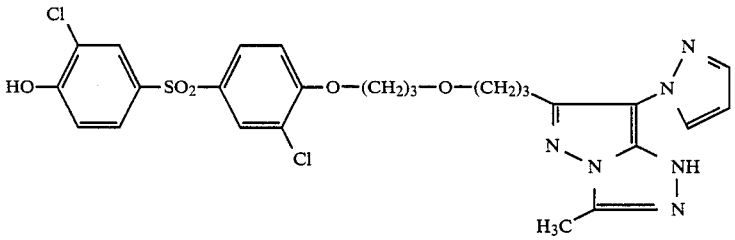

4. The silver halide color photographic material as claimed in claim 1, wherein said monodispersed silver halide emulsions are regulated to have a ratio of $\sigma/\bar{d}$ of 0.15 or less, where $\sigma$ means a statistical standard deviation in the particle size distribution and $\bar{d}$ means an average particle diameter, and these are represented by the following formulae, respectively:

$$\sigma=[\Sigma(\bar{d}-di)^2ni/\Sigma ni]^{\frac{1}{2}}$$

$$\bar{d}=\Sigma dini/\Sigma ni$$

wherein "di" means a diameter of a spherical or nearly spherical particle in the "i"th class when the particle size of the silver halide particles is classified into "m" groups; and "ni" means the number of the particles in the "i"th class.

5. The silver halide color photographic material as claimed in claim 4, wherein said monodispersed silver halide emulsions are regulated to have a ratio of $\sigma/\bar{d}$ of 0.12 or less.

6. The silver halide color photographic material as claimed in claim 1, wherein said monodispersed silver halide emulsions each having a different sensitivity are so admixed that the difference in the sensitivity between the silver halide emulsion of the highest sensitivity and the silver halide emulsion of the lowest sensitivity is 0.1 to 0.6 log E.

7. The silver halide color photographic material as claimed in claim 6, wherein said difference in sensitivity is 0.2 to 0.5 log E.

8. The silver halide color photographic material as claimed in claim 1, wherein said monodispersed silver halide emulsions each having a different sensitivity are so admixed that 10 to 60% of said emulsions are those of the highest sensitivity and the remaining 90 to 40% are those of lower sensitivity.

* * * * *